US010198908B2

(12) United States Patent
Dabrowski

(10) Patent No.: US 10,198,908 B2
(45) **Date of Patent: *Feb. 5, 2019**

(54) METHOD AND APPARATUS FOR INTEGRATED CUSTOMER TRACKING AND BROWSING

(71) Applicant: Stanley P. Dabrowski, Las Vegas, NV (US)

(72) Inventor: Stanley P. Dabrowski, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/707,978

(22) Filed: Sep. 18, 2017

(65) Prior Publication Data

US 2018/0005489 A1 Jan. 4, 2018

Related U.S. Application Data

(63) Continuation-in-part of application No. 15/231,583, filed on Aug. 8, 2016, now Pat. No. 9,767,649, which is a continuation of application No. 14/526,362, filed on Oct. 28, 2014, now Pat. No. 9,412,231, which is a continuation-in-part of application No. 13/367,930, filed on Feb. 7, 2012, now Pat. No. 8,870,641, which is a continuation of application No. 12/046,110, filed on Mar. 11, 2008, now Pat. No. 8,123,613, which is a continuation-in-part of application No. 10/261,142, filed on Sep. 30, 2002, now Pat. No. 7,341,516.

(51) Int. Cl.
*G07F 17/32* (2006.01)

(52) U.S. Cl.
CPC ..... *G07F 17/3255* (2013.01); *G07F 17/3239* (2013.01)

(58) Field of Classification Search
CPC ..... G07F 17/3225
See application file for complete search history.

(56) References Cited

U.S. PATENT DOCUMENTS

| | | | |
|---|---|---|---|
| 4,283,709 | A | 8/1981 | Lucero et al. |
| 4,636,951 | A | 1/1987 | Harlick |
| 4,764,666 | A | 8/1988 | Bergerom |
| 4,880,237 | A | 11/1989 | Kishishita |
| 5,083,022 | A | 1/1992 | Miyamoto et al. |
| 5,179,517 | A | 1/1993 | Sarbin et al. |
| 5,239,165 | A | 8/1993 | Novak |
| 5,265,874 | A | 11/1993 | Dickinson et al. |
| 5,290,033 | A | 3/1994 | Bittner et al. |
| 5,321,241 | A | 6/1994 | Craine |
| 5,371,345 | A | 12/1994 | LeStrange et al. |
| 5,470,079 | A | 11/1995 | LeStrange et al. |
| 5,627,356 | A | 5/1997 | Takemoto et al. |

(Continued)

FOREIGN PATENT DOCUMENTS

| | | |
|---|---|---|
| WO | 94/16781 | 8/1994 |
| WO | 98/59311 | 12/1998 |

*Primary Examiner* — Omkar Deodhar
(74) *Attorney, Agent, or Firm* — Gates & Cooper LLP

(57) ABSTRACT

A system and method for tracking customer activity without need for an extensive interconnecting network. The system includes a plurality of gaming devices that are communicatively isolated from one another. Information, including tracked customer activity, bonus requirements, and in one embodiment, personal information, is stored on a memory device communicable with the gaming devices. This allows implementation of an incentive program at reduced cost because the service devices themselves need not be networked together.

75 Claims, 15 Drawing Sheets

(56) References Cited

U.S. PATENT DOCUMENTS

| | | | |
|---|---|---|---|
| 5,709,603 | A | 1/1998 | Kaye |
| 5,761,647 | A | 6/1998 | Boushy |
| 5,772,510 | A | 6/1998 | Roberts |
| 6,012,832 | A | 1/2000 | Saunders et al. |
| 6,014,594 | A | 1/2000 | Heidel et al. |
| 6,048,269 | A | 4/2000 | Burns et al. |
| 6,113,492 | A | 9/2000 | Walker et al. |
| 6,128,550 | A | 10/2000 | Heidel et al. |
| 6,227,972 | B1 | 5/2001 | Walker et al. |
| 6,231,445 | B1 | 5/2001 | Acres |
| 6,253,119 | B1 | 6/2001 | Dabrowski |
| 6,340,331 | B1 | 1/2002 | Saunders et al. |
| 6,577,733 | B1 | 6/2003 | Charrin |
| 6,607,441 | B1 | 8/2003 | Acres |
| 6,712,698 | B2 | 3/2004 | Paulsen et al. |
| 6,722,985 | B2 | 4/2004 | Criss-Puszkiewicz et al. |
| 6,896,618 | B2 | 5/2005 | Benoy et al. |
| 7,036,012 | B2 | 4/2006 | Charrin |
| 2004/0147299 | A1 | 7/2004 | Morris et al. |

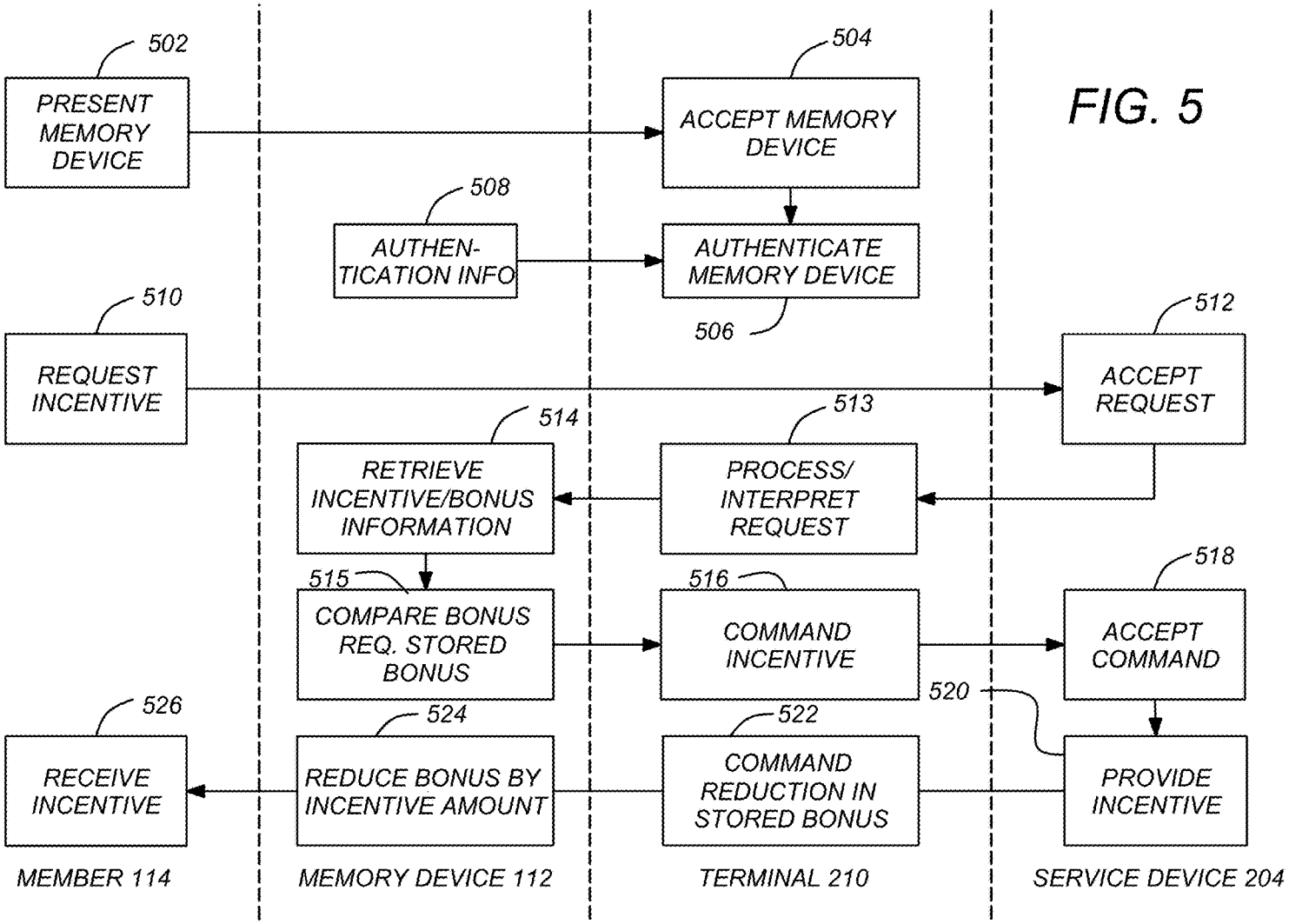
FIG. 5
502
PRESENT MEMORY DEVICE
504
ACCEPT MEMORY DEVICE
508
AUTHEN-TICATION INFO
506
AUTHENTICATE MEMORY DEVICE
510
REQUEST INCENTIVE
512
ACCEPT REQUEST
513
PROCESS/ INTERPRET REQUEST
514
RETRIEVE INCENTIVE/BONUS INFORMATION
515
COMPARE BONUS REQ. STORED BONUS
516
COMMAND INCENTIVE
518
ACCEPT COMMAND
520
PROVIDE INCENTIVE
522
COMMAND REDUCTION IN STORED BONUS
524
REDUCE BONUS BY INCENTIVE AMOUNT
526
RECEIVE INCENTIVE
MEMBER 114
MEMORY DEVICE 112
TERMINAL 210
SERVICE DEVICE 204

602
XMIT FIRST XMISSION
First Xmission
604
RECEIVE FIRST TRANSMISSION
606
AUTHENTICATE MEMORY DEVICE
AUTHEN-TICATION INFO
605
608
DISPLAY STATUS
ACCEPT COMMANDS
612
PROVIDE COMMAND RESPONSE
614
616
COLLECT AND TRANSMIT FIRST INFORMATION
618
RECEIVE AND STORE FIRST INFORMATION
610
ISSUE DEVICE COMMANDS
SERVICE DEVICE 204 (In First Casino)
TERMINAL 210 (In First Casino)
MEMORY DEVICE 112
MEMBER 114

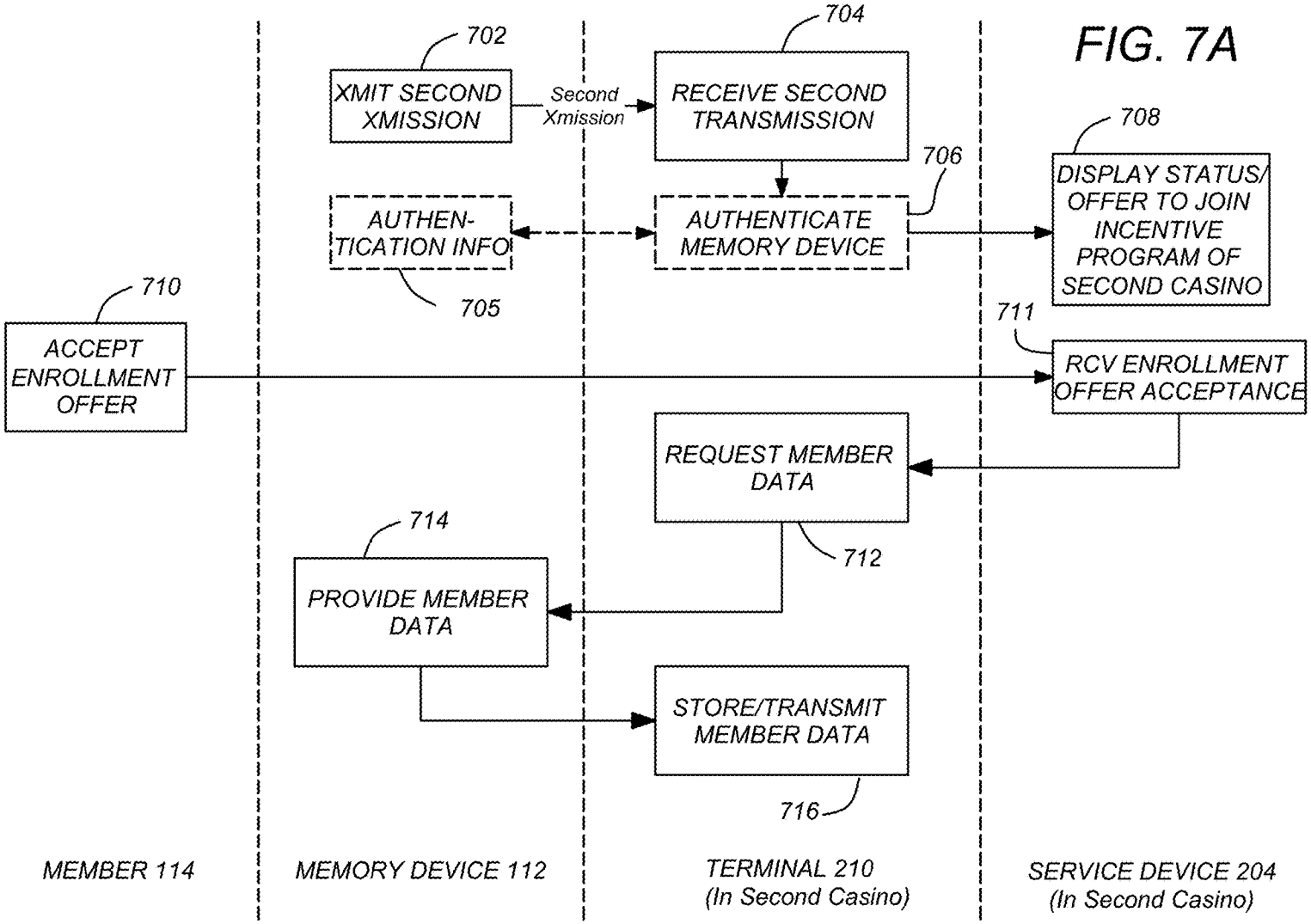
FIG. 7A
SERVICE DEVICE 204 (In Second Casino)
TERMINAL 210 (In Second Casino)
MEMORY DEVICE 112
MEMBER 114
702
XMIT SECOND XMISSION
Second Xmission
704
RECEIVE SECOND TRANSMISSION
706
AUTHENTICATE MEMORY DEVICE
705
AUTHEN-TICATION INFO
708
DISPLAY STATUS/ OFFER TO JOIN INCENTIVE PROGRAM OF SECOND CASINO
710
ACCEPT ENROLLMENT OFFER
711
RCV ENROLLMENT OFFER ACCEPTANCE
712
REQUEST MEMBER DATA
714
PROVIDE MEMBER DATA
716
STORE/TRANSMIT MEMBER DATA

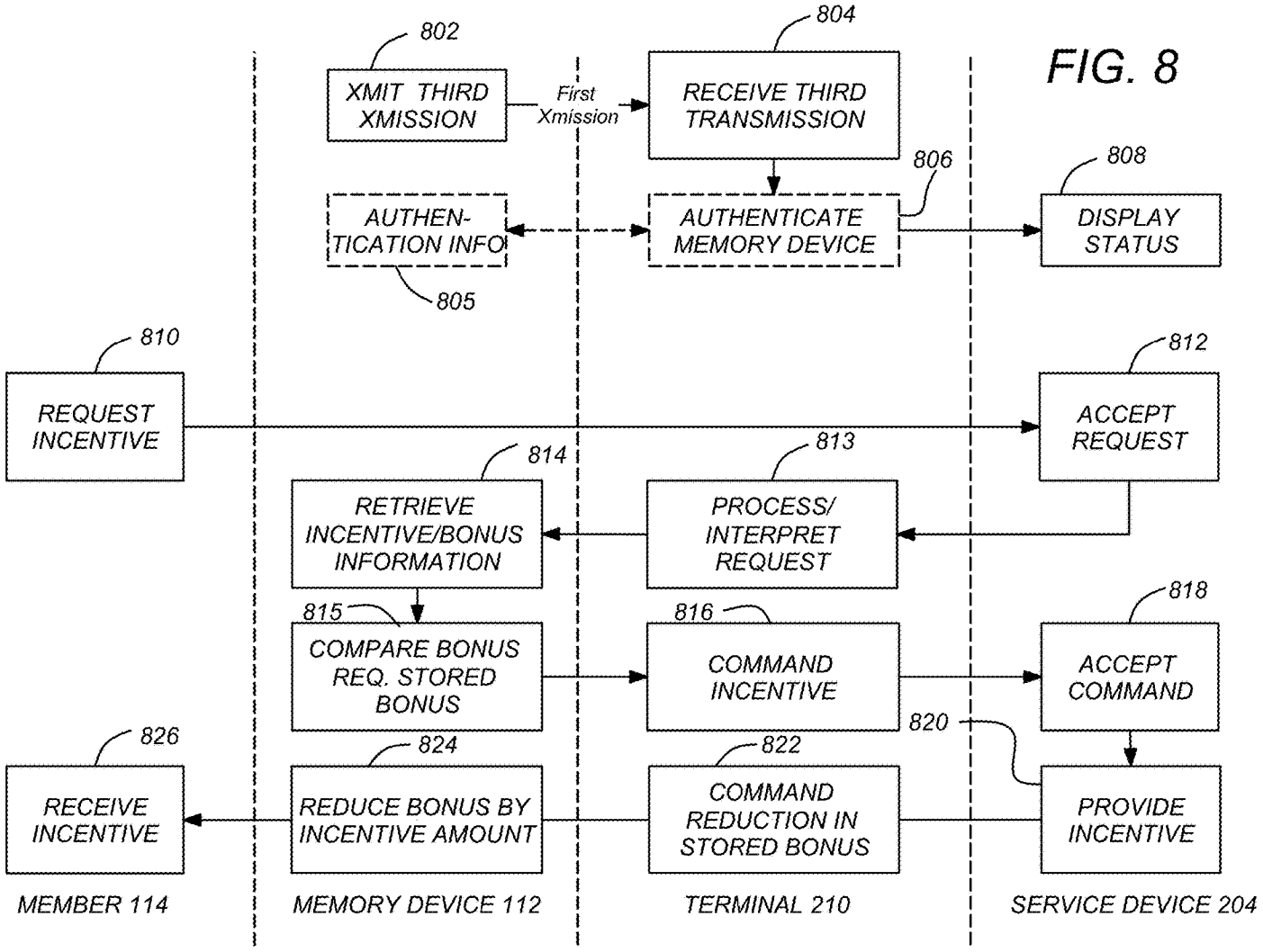
FIG. 8
802
XMIT THIRD XMISSION
First Xmission
804
RECEIVE THIRD TRANSMISSION
806
AUTHENTICATE MEMORY DEVICE
AUTHEN-TICATION INFO
805
808
DISPLAY STATUS
810
REQUEST INCENTIVE
812
ACCEPT REQUEST
813
PROCESS/ INTERPRET REQUEST
814
RETRIEVE INCENTIVE/BONUS INFORMATION
815
COMPARE BONUS REQ. STORED BONUS
816
COMMAND INCENTIVE
818
ACCEPT COMMAND
820
PROVIDE INCENTIVE
822
COMMAND REDUCTION IN STORED BONUS
824
REDUCE BONUS BY INCENTIVE AMOUNT
826
RECEIVE INCENTIVE
SERVICE DEVICE 204
TERMINAL 210
MEMORY DEVICE 112
MEMBER 114

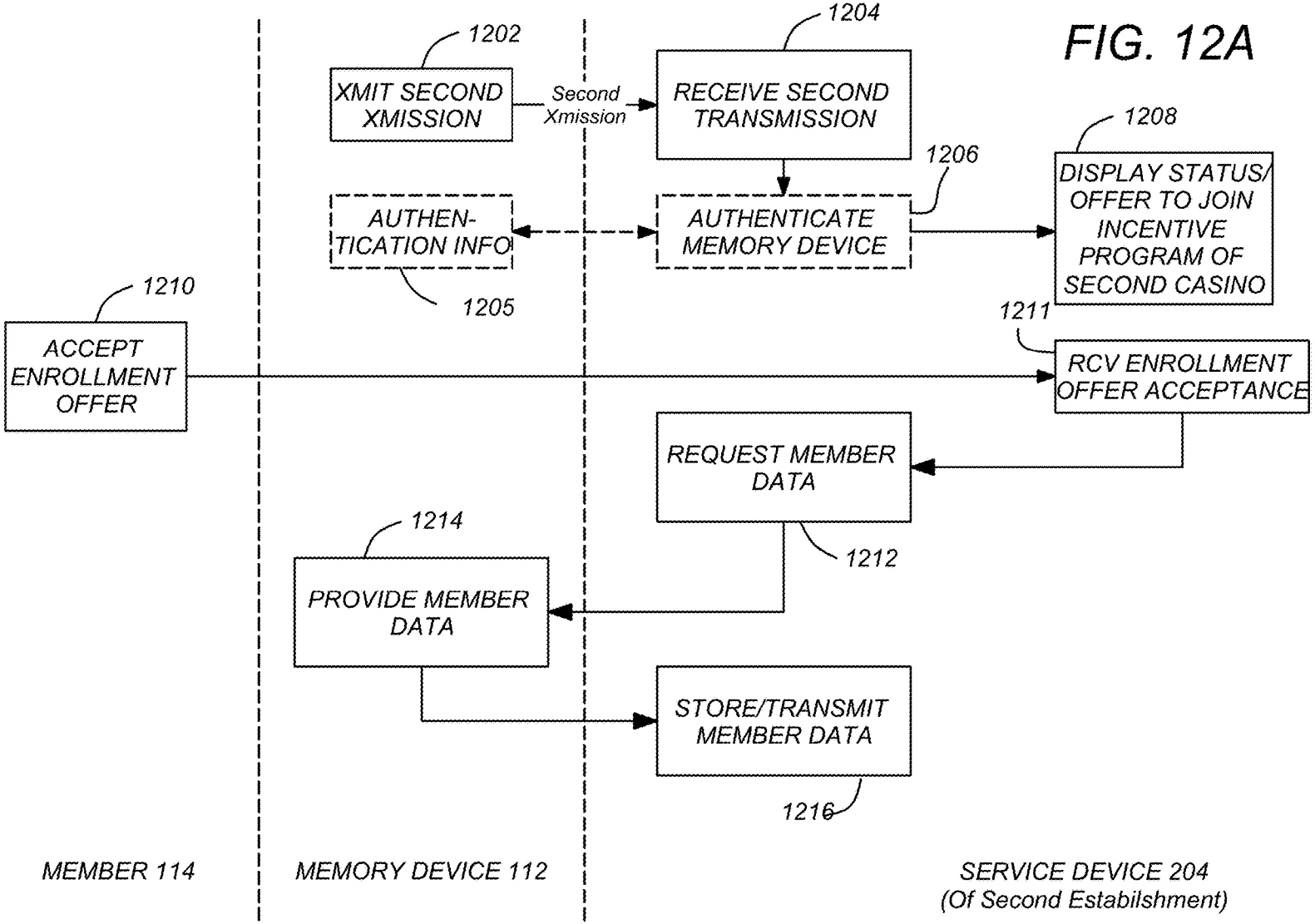
FIG. 12A
1202
XMIT SECOND XMISSION
Second Xmission
1204
RECEIVE SECOND TRANSMISSION
1205
AUTHEN-TICATION INFO
1206
AUTHENTICATE MEMORY DEVICE
1208
DISPLAY STATUS/ OFFER TO JOIN INCENTIVE PROGRAM OF SECOND CASINO
1210
ACCEPT ENROLLMENT OFFER
1211
RCV ENROLLMENT OFFER ACCEPTANCE
1212
REQUEST MEMBER DATA
1214
PROVIDE MEMBER DATA
1216
STORE/TRANSMIT MEMBER DATA
MEMBER 114
MEMORY DEVICE 112
SERVICE DEVICE 204
(Of Second Estabilshment)

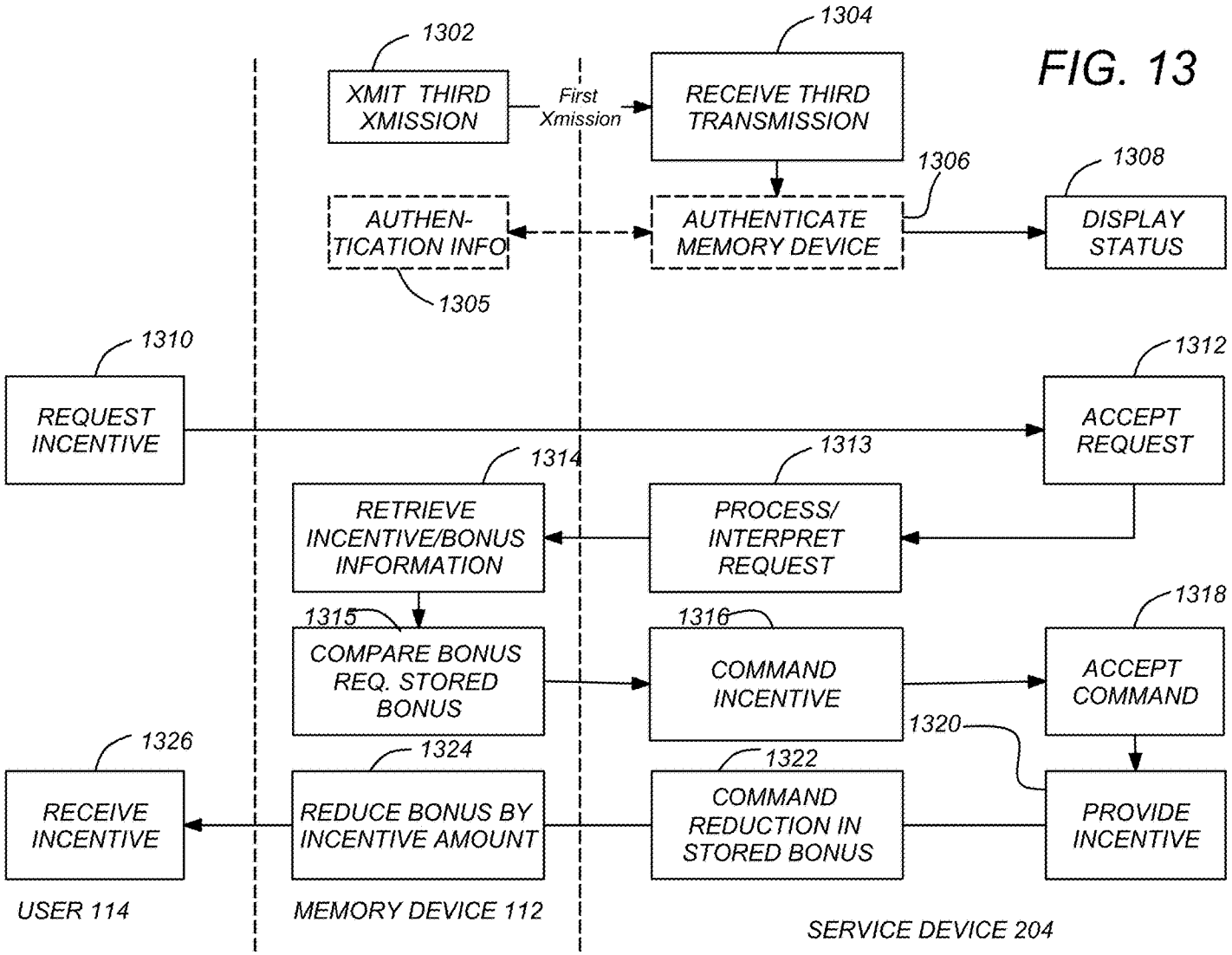
FIG. 13
1302
XMIT THIRD XMISSION
First Xmission
1304
RECEIVE THIRD TRANSMISSION
1305
AUTHEN-TICATION INFO
1306
AUTHENTICATE MEMORY DEVICE
1308
DISPLAY STATUS
1310
REQUEST INCENTIVE
1312
ACCEPT REQUEST
1313
PROCESS/ INTERPRET REQUEST
1314
RETRIEVE INCENTIVE/BONUS INFORMATION
1315
COMPARE BONUS REQ. STORED BONUS
1316
COMMAND INCENTIVE
1318
ACCEPT COMMAND
1320
PROVIDE INCENTIVE
1322
COMMAND REDUCTION IN STORED BONUS
1324
REDUCE BONUS BY INCENTIVE AMOUNT
1326
RECEIVE INCENTIVE
SERVICE DEVICE 204
MEMORY DEVICE 112
USER 114

METHOD AND APPARATUS FOR INTEGRATED CUSTOMER TRACKING AND BROWSING

CROSS-REFERENCE TO RELATED APPLICATIONS

This application is a continuation in part of U.S. patent application Ser. No. 15/231,583, entitled "METHOD AND APPARATUS FOR INTEGRATED CUSTOMER TRACKING AND BROWSING," by Stanley P. Dabrowski, filed Aug. 8, 2016, issued Sep. 19, 2017 as U.S. Pat. No. 9,767,649, which application is a continuation of U.S. patent application Ser. No. 14/526,362, entitled "METHOD AND APPARATUS FOR INTEGRATED CUSTOMER TRACKING AND BROWSING," by Stanley P. Dabrowski, filed Oct. 28, 2014, issued Aug. 9, 2016 as U.S. Pat. No. 9,412,231, which application is a continuation-in-part of U.S. patent application Ser. No. 13/367,930, entitled "METHOD AND APPARATUS FOR INTEGRATED CUSTOMER TRACKING AND BROWSING," by Stanley P. Dabrowski, filed Feb. 7, 2012, issued Oct. 28, 2014 as U.S. Pat. No. 8,870,641;

which application is a continuation of U.S. patent application Ser. No. 12/046,110, entitled "METHOD AND APPARATUS FOR INTEGRATED CUSTOMER TRACKING AND BROWSING," by Stanley P. Dabrowski, filed Mar. 11, 2008, issued Feb. 28, 2012 as U.S. Pat. No. 8,123,613;

which application is a continuation-in-part of U.S. patent application Ser. No. 10/261,142, entitled "METHOD AND APPARATUS FOR INTEGRATED CUSTOMER TRACKING AND BROWSING," By Stanley P. Dabrowski, filed Sep. 30, 2002; issued Mar. 11, 2008 as U.S. Pat. No. 7,341,516;

all of which applications are hereby incorporated by reference herein.

BACKGROUND OF THE INVENTION

1. Field of the Invention

The present invention relates to systems and methods for monitoring and recording transactions, and in particular, to a system and method for tracking customer activity without need for an extensive interconnecting network.

2. Description of the Related Art

Recent years have seen a rapid expansion of the gaming industry. Much of the income derived from such games is collected at gaming devices like slot machines and video poker games.

To attract customers, larger goods and/or service providers (e.g. gaming establishments) implement "frequent player" programs in which players can obtain bonuses and other benefits each time they play machines in that particular establishment or its affiliates. Such "frequent player" or "loyalty" programs may also permit the goods/service provider to monitor customer activity. This permits the service/goods provider to customize the services and goods presented to each customer or group of customers so that each customer's needs are better met. In many instances, the customer agrees to permit the collection of such information in exchange for lower prices, a bonus program, or other incentives offered by the service/goods provider. In such circumstances, it is important to include some medium or means for keeping track of each customer's loyalty program.

One solution to this problem is to provide a network of interconnected computers or similar devices at the point of sale/service. Each device can collect information regarding the sale and provide that information to a central database, where the data can be stored and analyzed. The problem with this solution is that it requires a substantial investment in the infrastructure (the interconnected network) itself. This substantial investment is typically greater than can be provided by smaller goods/service providers.

Another problem with the use of a network of interconnected computers or similar devices at the point of sale/service is that such systems do not ordinarily permit the user to earn incentives at different establishments. For example, whatever device is used to keep track of one entity's incentive program is typically unusable in for another entity's incentive program. This forces the customer to carry a device for each establishment they patronize.

Typically, customers are not permitted to earn incentives at a first establishment by purchasing goods or services at another unrelated establishment. For example, if a customer is a member of the incentive program of a first casino, game play at a second casino cannot be used to earn incentives at the first casino. Also, incentives earned at the first casino cannot be redeemed at the second casino. While it may not seem advantageous for the second casino to allow customers to redeem incentives earned at another commercially distinct casino, allowing the player to make such redemption encourages the customer to play at the second casino, and once they begin playing there, they are likely to remain.

What is needed is an inexpensive system and method for monitoring and recording gaming activity that eases data collection, reduces the risk of theft, does not negatively influence impulse gaming. What is also needed is a system for providing appropriate incentives, without need for an extensive (and expensive) infrastructure, and one that permits customers to earn and redeem incentives at commercially distinct casinos. The present invention satisfies these needs.

SUMMARY OF THE INVENTION

To address the requirements described above, the present invention discloses a method, apparatus, article of manufacture, and a memory structure for providing gaming incentives. The method comprising the steps of receiving a first transmission from a secure memory device in a terminal communicatively coupled to one of a plurality of first gaming devices of a first casino, collecting first information describing member-related gaming device activity of the one of the plurality of first gaming devices, securely transmitting the first information regarding the member-related gaming device activity to the memory device for storage in the secure memory, receiving a second transmission from the secure memory device in a second terminal communicatively coupled to one of a second plurality of gaming devices of a second casino commercially distinct from the first casino, enrolling the member of the first incentive program of the first casino in a second incentive program of the second casino, collecting second information describing member-related gaming device activity of the one of the second plurality of gaming devices of the second casino, and securely transmitting the second information regarding the member-related gaming device activity to the memory device for storage in the secure memory.

In another embodiment, the apparatus comprises means for receiving a first transmission from a secure memory device in a terminal communicatively coupled to one of a plurality of first gaming devices of a first casino, means for collecting first information describing member-related gaming device activity of the one of the plurality of first gaming devices, means for securely transmitting the first information regarding the member-related gaming device activity to the memory device for storage in the secure memory, means for receiving a second transmission from the secure memory device in a second terminal communicatively coupled to one of a second plurality of gaming devices of a second casino commercially distinct from the first casino, means for enrolling the member of the first incentive program of the first casino in a second incentive program of the second casino, means for collecting second information describing member-related gaming device activity of the one of the second plurality of gaming devices of the second casino, means for securely transmitting the second information regarding the member-related gaming device activity to the memory device for storage in the secure memory.

In one embodiment, the secure memory device is issued to a member of a first incentive program of the first casino, the memory device having a secure memory for storing and retrieving tamperproof customer incentive information and a customer-unique identifier, the terminal exchanges information between the secure memory device and the one of the plurality of gaming devices and the plurality of first gaming devices includes at least a subset of first gaming devices that are communicatively isolated from any entity communicatively connected with any of the other of the plurality of first gaming devices. Further, the second terminal exchanges information between the secure memory device and the one of the second plurality of gaming devices and the plurality of second gaming devices includes at least a subset of second gaming devices that are communicatively isolated from any entity communicatively connected with any of the other of the plurality of second gaming devices.

BRIEF DESCRIPTION OF THE DRAWINGS

Referring now to the drawings in which like reference numbers represent corresponding parts throughout:

FIG. 5 is a diagram showing exemplary operations usable to use incentives earned based on stored information derived from customer related device activity;

FIGS. 7A and 7B are diagrams illustrating the use of the memory device to track incentives at a second casino and in which the possessor of the memory device is not initially a member of the incentive program at the second casino;

FIG. 8 is a diagram illustrating the redemption of a bonus amount to receive an incentive from the first and/or the second casino;

FIGS. 11-13 are diagrams presenting another embodiment in which the memory device can be used in connection with incentive programs at commercially distinct establishments.

DETAILED DESCRIPTION OF THE PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1:
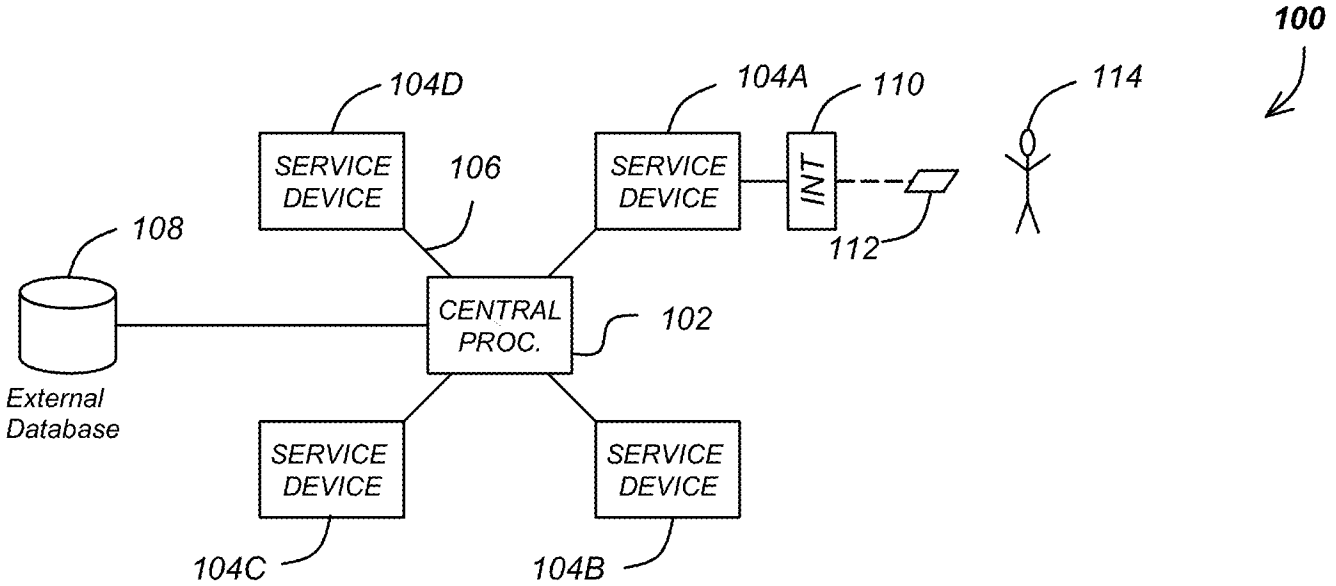
FIG. 1 PRIOR ART
FIG. 1 is a diagram of a plurality of service devices in a networked configuration.

FIG. 1 is a diagram of a networked (e.g. communicatively interconnected) plurality of service devices. The service device network 100 includes a plurality of service devices 104A-104C (alternatively referred to as service device(s) 104), each coupled to a central processor 102 via network links 106. The central processor 102 can be coupled to an internal or external database 108. The service devices 104 can be vending machines, gaming machines, video games, or any other machine that provides goods and/or services to customers. A consumer 114 interfaces with the service devices 104 using input/output (I/O) devices on the service devices. For example, when the service devices 104 are gaming machines, the consumer or user 114 uses the I/O devices to provide monetary value to the gaming device, and depending on the game, may provide other gaming and other inputs as well. The gaming device provides an output display showing the results and status of each game.

The owner or operator of the service device network 100 may elect to provide an incentive program to attract more consumers. The incentive program provides the member a reward for consuming the goods or using the service devices 104. The reward may be provided simply to attract more consumers 114, or may be provided in exchange for personal information regarding the consumer 114 or the consumer's preferences and habits regarding the use/consumption of the goods/services offered by the service devices 104. In one embodiment, the incentive program is implemented by use of loyalty cards or other memory devices 112 that identify the consumer 114. When the consumer 114 enters the memory device 112 into an interface 110, the consumer 114 is identified, and information regarding the use of the service device 104 by the consumer 114 can be transmitted to the central processor 102 for processing and storage in a database 108, which can be external or internal to the processor 102. The memory device 112, can be a read only device, such as an optical bar code or magnetic card, or may be a read/write device.

Unfortunately, the incentive programs based on the service device network 100 require that each of the service devices 104 be networked together. Such networks can be prohibitively expensive for smaller service device owner/operators.

Figure 2:
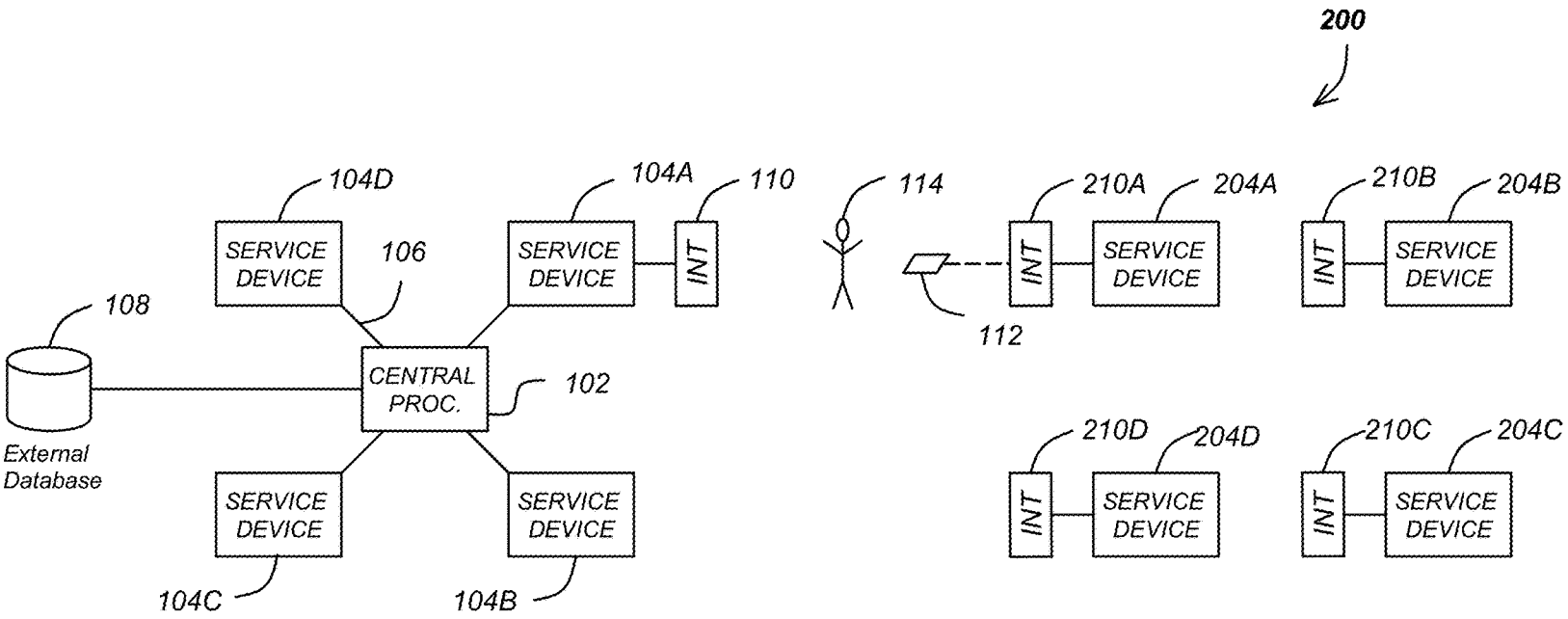
FIG. 2 is a diagram of a plurality of service devices, a subset of which are in a non-networked configuration.

FIG. 2 is a diagram of a diagram of hybrid service device network, which includes an interconnected service device network 100 and a distributed service device network (DSDN) 200. The DSDN 200 comprises a plurality of service devices 204A-204B such as gaming devices (hereinafter referred to alternatively as gaming devices or service device(s) 204). Unlike the interconnected service device network 100, the service devices 204 of the DSDN 200 are communicatively isolated (they are not networked together). Each of the service devices 204A-204D includes an associated terminal 210A-210D that can accept a memory device 112. In one embodiment, the memory device 112 is a programmably alterable memory device such as a smart card, flash memory, secure digital card, or radio frequency identification (RFID) device. Hereinafter, the terms memory device, smartcard, token, and RFID device are used interchangeably to describe this functionality. Similarly, in one embodiment, the terminals 210A-210D may include smartcard reader/writers (210A-210D) (hereinafter also referred to as SRWs 210).

Once the memory device 112 is accepted, the SRW 210 can read and write data from the memory device 112. The memory device 112 and SRW 210 are each configured so that read and write operations are performed in a secure (non-hackable) way, and so that the contents of the memory device 112 cannot be altered or duplicated without special authorization. The SRW 210 may also be capable of selecting different operational modes or reprogramming the memory device 112.

The memory device 112 is personal to the user 114 and contains the information required for the incentive program. In one embodiment, this information includes personal data about the member 114. In another embodiment (the opt-out embodiment described below), the memory device 112 does not store personal data about the member 114.

Once connected to the service device 204, the smartcard extracts service device activity information. In the gaming establishment context, this service device activity information includes player input(s), gaming machine outcome(s). Input and outcomes can be recorded as singular events. For example, the service device activity can be described (and recorded) as a number of games played, a number of games played per week, a number of games played on particular days or at particular times, the number of wagers, the number of wagers within certain amount bins (e.g. $0.25, $1, or $5), number of particular outcomes (e.g. number of blackjacks, or royal flushes, or queens), combinations (e.g. number of hands with face cards and deuces, number of consecutive winning or non-winning hands). Further, the tracked outcomes can be customizable to the member 114. For example, the member 114 may select particular "lucky" combinations (personal bonus combinations) for bonus awards (e.g. number of hands with both deuces and queens), and the member's selection can be stored on the memory device 112 thereby permitting the member 114 to earn bonuses for these results.

The foregoing information can be used to compute and store member bonuses, and to manage special member offers.

Figure 3:
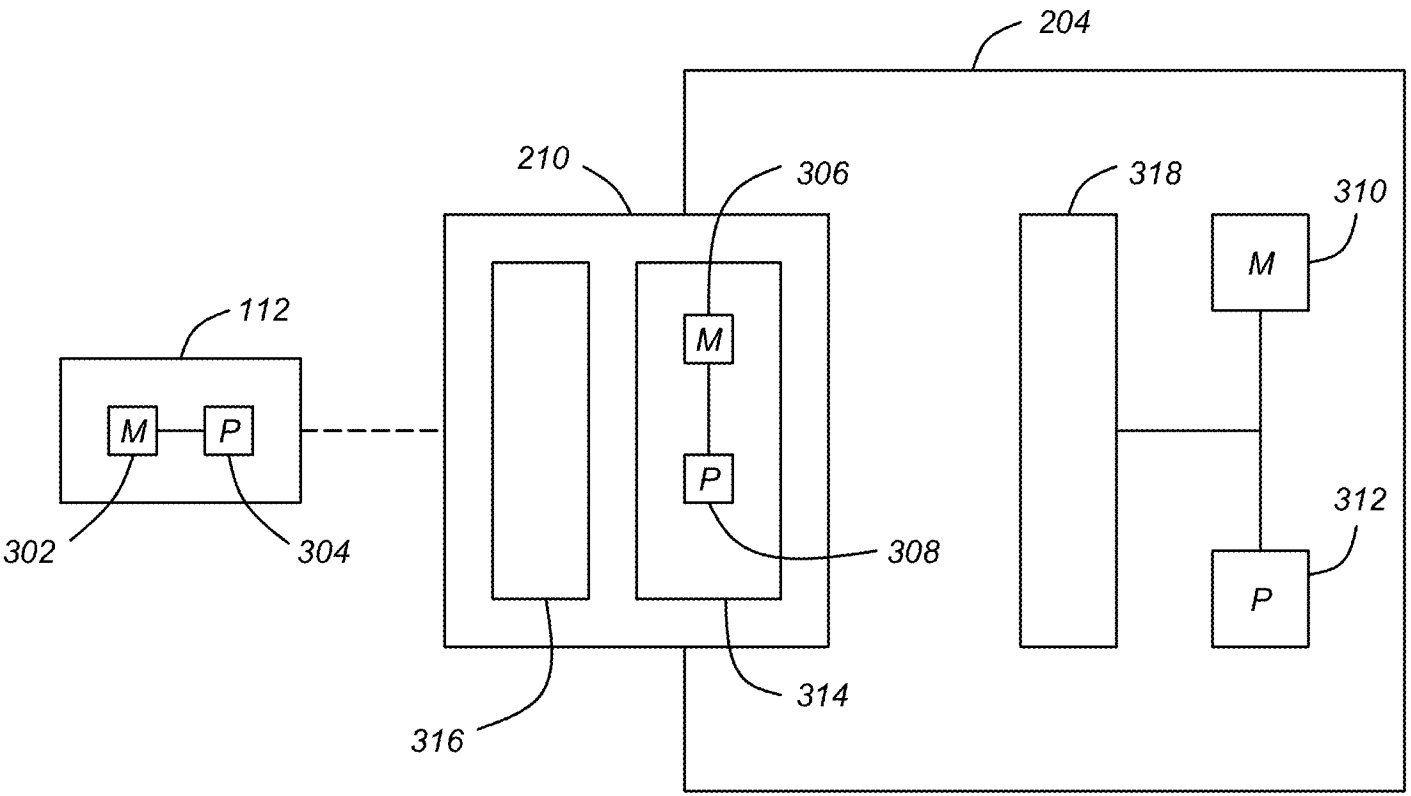
FIG. 3 is a diagram of a memory device, terminal and service device.

FIG. 3 is a diagram depicting a memory device 112, terminal 210, and service device 204. In one embodiment, the memory device 112 includes an internal memory 302 and a processor 304. The memory 302 comprises non-volatile memory storage which may include both read only memory (ROM) and randomly addressable memory (RAM). The memory 302 may also include a secure memory area for storing passwords, and sensitive data used to implement security routines. The processor 304 response to instructions that may be stored in the memory 302, and performs the memory device-related functions described herein.

The memory device 112 may be a smartcard, a flash memory such as a USB flash drive, a secure memory such as a Secure Digital card, or a radio frequency identification (RFID) device. RFID devices may include passive devices, semi-passive devices, active devices, and extended capability devices. Passive devices have no internal power supply, but use the electrical current induced in its antenna by a nearby RF signal to power the device. The response of the passive device may be a simply ID number, but may include additional data read from the non-volatile memory. Passive RFID devices may have privacy enhancing functionality such as communication encryption and silent moding, which prevents the device from transmitting information unless the user authorizes the transmission. Active RFID devices include their own internal power source and may include processors and other circuits. Extended capability RFID devices include similar features.

Each of the terminals 210 includes a controller 314 and a read/write device 316. The controller 314 communicates with the smartcard via the read/write device 316. Communication between the terminal 210 and the service device 204 may be performed via an interface 318 which obtains status and other information from the service device 204.

In one embodiment, the memory device 112 is removably coupleable to the terminal 210. In another embodiment described below, the memory device 112 is a wireless device that can exchange information with the terminal without physical connection. Once in communication with the terminal 210 the memory device 112 and the terminal 210 can share information as required to implement the incentive program. The terminal 210 (e.g. SRW) may include an internal memory 306 communicatively coupled to a SRW processor 308. The internal memory 306 may include RAM and/or ROM.

The terminal is communicatively (and may be physically) coupled to the service device 204. Although not necessary to practice the invention, the service device 204 typically includes a processor 312 and a memory 310 that is used to implement service device 204 functions.

Figure 4:
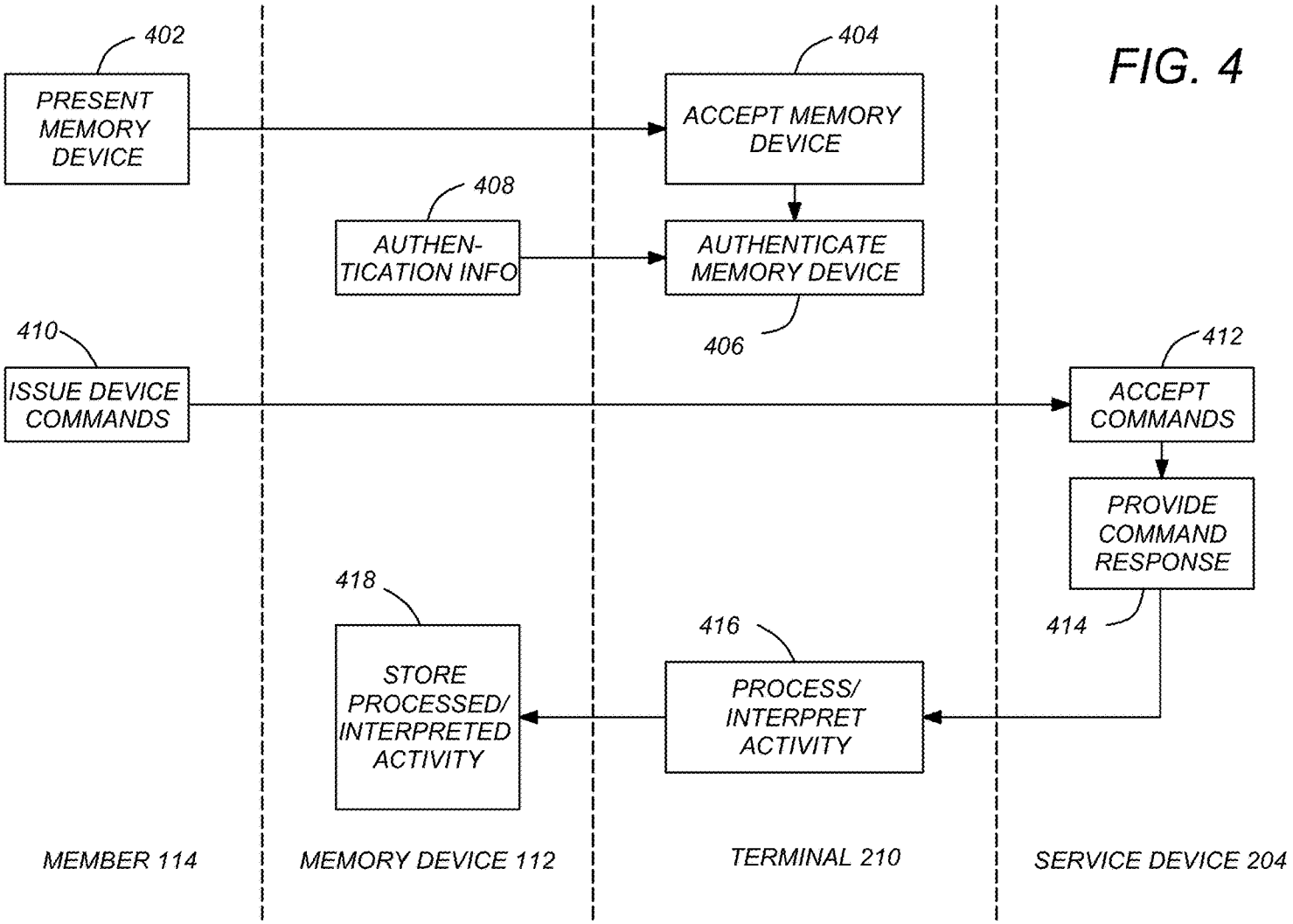
FIG. 4 is a diagram showing exemplary operations usable to collect customer-related service device activity.

FIG. 4 is a diagram showing exemplary method steps useable to collect member-related service device 204 activity. The member 114 presents 402 the memory device 112 to the terminal 210, which accepts 404 and authenticates 406 the memory device 112 using authentication information 408 stored in the memory device 112 and/or the terminal 210. In one embodiment, the terminal 210 requests that the member 114 enter identifying information (e.g. a name and/or a password) as a part of the authentication process. If desired, the present invention can be implemented without blocks 402-408. In this embodiment, the possessor of the memory device 112 is not authenticated.

The member 114 then issues 410 service device 204 commands via an appropriate service device user interface. This may include, for example, entering a monetary denomination (e.g. a $20 bill), and depressing buttons to select game play, including the number of credits to risk, and making additional selections regarding game play (e.g. in a draw poker game, which cards to retain). The service device 204 accepts 412 the commands, and provides 414 a command response. The terminal 210 processes and/or interprets 416 the command response from the service device 204 and provides the activity information, in processed or unprocessed form, to the memory device 112, where it is stored 418.

Some or all of the terminals 210 also may allow member 114 to read some or all of the information regarding earned bonuses, bonus detail (e.g. number of bonus points, how many jackpots or royal flushes), or bonus requirements stored on the memory device 112.

FIGS. 3 and 4 show an embodiment of the invention wherein the terminal 210 includes a processor 308 and memory 306 that is used to process and/or interpret the service device 204 activity. However, the processor 304 and memory 302 in the memory device 112 can also perform many or all of the functions performed by the terminal 210 processor 308 and memory 306. This embodiment permits the present invention to be implemented with a minimum investment in terminal 210 hardware. Sharing functionality between the memory device and the terminal 210 can also increase security and prevent hacking of the memory device 112 and/or the terminal 210.

FIG. 5 is a diagram depicting exemplary method steps used to redeem incentives. The member 114 presents 502 the memory device 112 to the terminal 210, where it is accepted 504. Authentication information 508 stored in the memory device 112 and/or the terminal 210 is then used to authenticate the member 114. As before, this could involve a process whereby the member 114 provides input to the terminal and/or the service device 204 (service device 204 I/O elements can be used to provide input/output interface during authentication, accumulating bonus incentives, or in receiving incentives).

The authentication process can be directed solely to processes that are required to authenticate the memory device 112, rather than the user (e.g., a case where possession of the card alone is sufficient). In this case, the member 114 accepts the risk of losing their memory device 112. Redemption devices may or may not be networked.

The member 114 then requests 510 the incentive. The service device 204 (either directly, or through the I/O devices of the terminal 210) accepts 512 the request. The terminal 210 processes/interprets 513 the request. The terminal 210 transmits a message to the memory device 112 requesting incentive/bonus information stored in the memory 302 of the memory device 112. The memory device 112 retrieves 514 the information, and provides the information to the terminal 210. The terminal 210 then compares 515 the earned bonus/incentive information received from the memory device 112 with bonus/incentive requirements stored in the terminal 210 and/or the memory device 112 and/or the service device 204. If the comparison indicates a bonus/incentive award is appropriate, the terminal/memory device 210/112 provides 516 a command to the service device 204 to provide the incentive. The service device 204 accepts 518 the command, and provides 520 the bonus/incentive. The terminal 210 receives the directive to provide the incentive from the service device, and commands the memory device 112 to decrement 524 the earned bonus by the amount redeemed. The memory device 112 accepts this command, and decrements 524 the earned bonus by the required amount. If desired, the present invention can be implemented without decrementing the bonus counter (e.g. awarding incentives when bonus thresholds are passed and therefore, triggered).

The incentive is then received 526 by the member 114. Alternatively, the incentive command may cause an alarm or other indication that the member 114, should be provided with a bonus, and the bonus is provided to the user by appropriate personnel alerted by the alarm.

The memory device 112 may or may not keep historical data regarding redemption transactions and earned bonuses. When the member 114 redeems bonus points or interfaces with a networked machine, the history of activity/bonus awards stored in the memory device 112 can be uploaded in the terminal 210. This information can be to offer the member 114 with additional player benefits or to update the bonus structure to a more or less favorable structure than currently stored in the memory device 112.

In one embodiment, special redemption stations can be used to collect bonus points (in addition to or in the alternative to the terminals 210 disclosed above). Such redemption stations can be networked and can include special functionality to permit the collection of data and the issuance of the incentive awards.

It is noted that the functions shown implemented in the memory device 112 and terminal 210 in FIG. 5 may be different than shown. For example, the memory device 112 may include stored incentive/bonus requirements, and the determination if the earned requirements permit an award can take place in the memory device 112 instead of (or in addition to) the terminal 210.

The foregoing can be implemented with 2 types of memory devices, an opt-in memory device, and a non-opt-in (or opt-out) memory device 112. The baseline (opt-out), card is anonymous, and offers the member 114 a different (and typically, less advantageous) bonus structure than does the opt-in memory device 112. The opt-in memory device 112 is provided to the user in exchange for the member 114 providing personal information their name, address, and other identifying information that may be useful to correlate with service device 204 use patterns. Such a card may provide increased benefits over the non-opt-in card (i.e. 2-cent bonus per dollar wagered versus a 1 cent per dollar wagered with the opt-put card). Further, either card may change the award as the amount of play (dollars wagered or games played) increases, or when the user plays (giving more bonus for off-peak hours). The opt-in card can also be updated from time to time, with additional information, permitting additional bonuses. For example, an opt-out card may provide 1 cent per dollar wagered, a standard opt-in card may provide 2 cents per dollar wagered, but based on how much the opt-in card is used, the rate of award may be increased as the member plays more. This is made possible because the memory device processor can include programs which allow changes in program execution, permitting adaptable bonus awards.

The foregoing invention can also be used with a networked service device incentive system. In this embodiment (illustrated in FIG. 2), the member 114 can use the service devices 204 in the DSDN 200, accumulating bonus points, and if desired, redeeming earned bonus points at any of the service devices 204. However, in this embodiment, the member 114 can also present the memory device 112 to a service device 104 in the networked system. In one embodiment, this functionality duplicates that of the un-networked system (i.e. the service device 104 communicates solely with the member's memory device 112) to accumulate bonus points or award bonuses. In another embodiment, the memory device 112 or the service device communicatively coupled thereto, interfaces with other service devices in the network 100, the server 102, and/or the database 108 to accumulate bonus points, award earned bonuses, or simply to report the data stored in the memory device 112 or store updated information regarding incentive/bonus requirements. In this embodiment, the memory device 112 operates primarily autonomously but can operate with the networked system when it is desired or available. This permits the occasional collection and retention of data regarding member 114 bonus points and service device activity. This permits opt-in users to retain their earned bonuses, even when the smartcard is lost or stolen, and provides another incentive for members 114 to become opted-in members.

One advantage in the foregoing system (with non-networked service devices) is that it permits the customers/members to determine for themselves when and if they would like to trade information regarding gaming activity (and/or personal information) for bonus incentives. For example, a system can be devised in which none of the service devices are networked or otherwise coupled to a central computer or database, and which redemption of bonus points takes place on clearly identified and networked redemption terminals. The customer can then use the memory device 112 in the ordinary way, secure in the knowledge that gaming activity or personal information will not (indeed, cannot) be shared. However, when the user elects to redeem earned bonus points, the user presents the card to a conspicuously identified networked machine, the information on the card (including game play and optionally, the user's personal information) can be collected. If the user does elects not to collect the bonus, the gaming activity or personal information is never revealed, but remains stored on the smartcard. The customer is therefore assured that activity and/or personal information stored in the smartcard will not be read until the customer makes the decision as to whether and when they would like to trade personal information for the incentive program.

In yet another embodiment of the invention, the member 114 does not have to make an immediate decision regarding whether to become an opted-in member. In this embodiment, the member 114 accepts an opted-out card, and can use the card as described above to collect bonus points. When the user attempts to redeem the bonus points for the incentive award, the member 114 is offered the opportunity to provide personal information in exchange for an enhanced bonus award.

Figure 6:
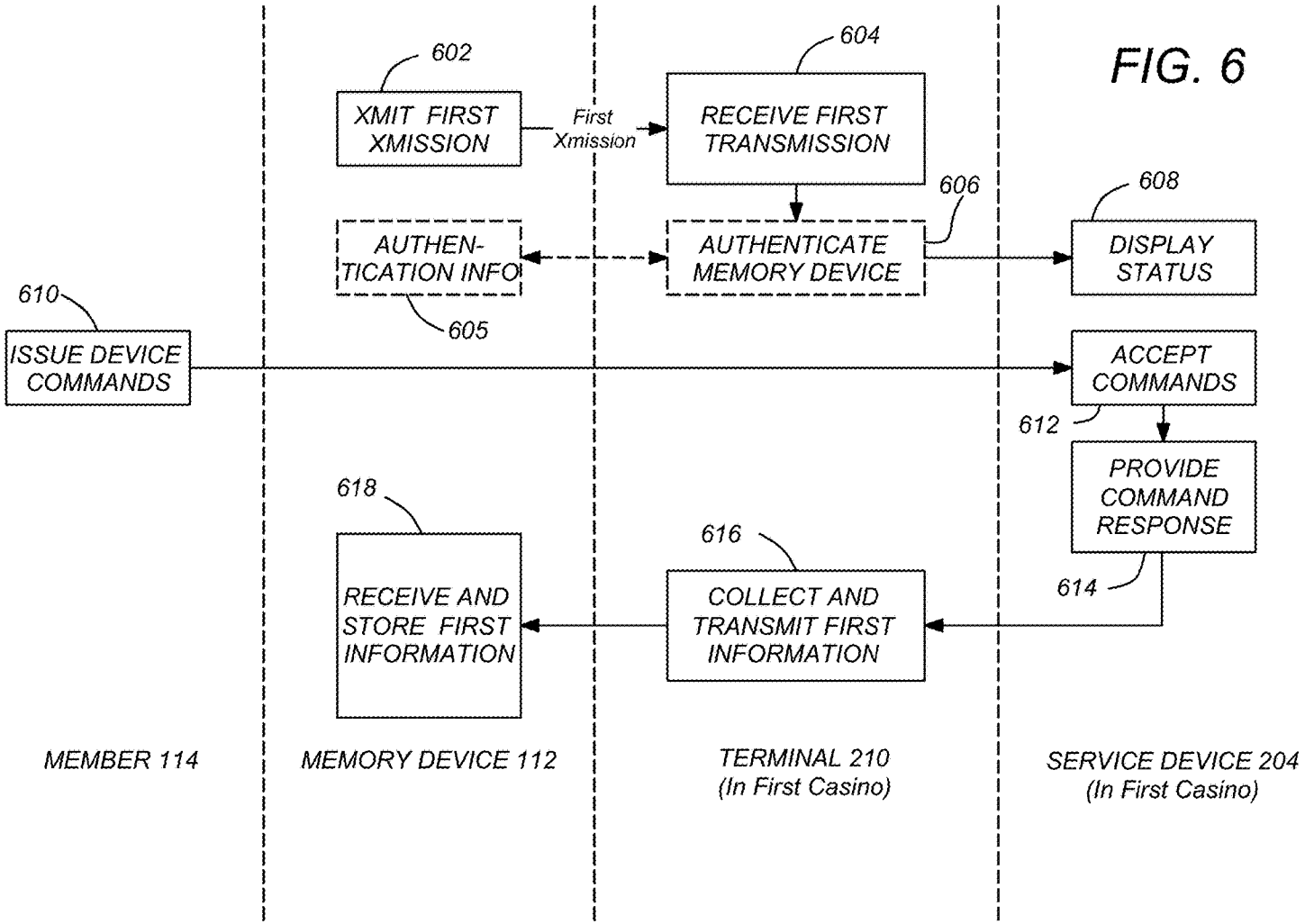
FIG. 6 is a diagram illustrating the use of the memory device to track incentives at a first casino and in which the possessor of the memory device is a member of an incentive program at the first casino.

FIGS. 6-8 is a diagram presenting yet another embodiment in which the memory device can be used in connection with incentive programs at commercially distinct casinos. In block 602, the memory device 112 transmits a first transmission to the terminal 210.

As described above, the memory device 112 may comprise a smartcard, a USB-based flash memory, a wireless device, or any portable means to store information. The memory device 112 is issued to a person that is a member of a first incentive program offered by a first casino, typically in exchange for the member's personal information and the right to collect information regarding game play.

In one embodiment, the memory device 112 comprises a device capable of wirelessly transmitting and receiving information from other devices. One example of such a device is an infrared or optical transceiver similar to that of a remote control. One example of such a device is a radio frequency identification (RFID) device. With wireless devices, the terminal 210 or service device 204 may sense the approach of the memory device 112, and in response, present a display recognizing the member and inviting the member to use the service device 204. The member 114 may elect to do so by selecting appropriate commands on the service device 204 or the terminal 210.

In block 604, the terminal 210 receives the first transmission, which may include simply the customer unique identifier. The terminal 210 is communicatively coupled to one of a plurality of service devices 204 in a first casino.

Using authentication information received from the memory device 112, the terminal 210 (or service device 204) can authenticate the memory device before proceeding further, as shown in block 606. The result of the authentication process can be displayed on a display of the service device 204 (e.g. the display of a video gaming device).

Thereafter, the member 114 can issued device commands such as game play commands that are accepted by a service device 204 in a first casino. This is illustrated in blocks 610 and 612. The service device provides a command response (e.g. game play) as shown in block 614. The terminal 210 collects and transmits first information describing the member's gaming activity, as shown in block 616. That information is transmitted to the memory device 112, as shown in bock 618. As described above, the information may be transmitted from the terminal to the memory device 112 as it is available, may be stored in the terminal 210 and periodically transmitted to the memory device 112, or may be transmitted to the memory device when the member 114 has completed game play (for example, by providing a cashout command).

Once the member 114 has cashed out, they may deactivate the memory device 112. In embodiments wherein the memory device 112 is in the form of a smartcard or USB flash memory, this may be accomplished by removing the memory device 112 from the terminal 210. In embodiments wherein the memory device 112 communicates wirelessly with the terminal 210 (e.g. an RFID device), the user may provide a command to end the session or simply walk away until they are out of range with the terminal 210. At this point, the member may approach another service device 204 and repeat the same operations in the first casino. However, the member 114 may leave the premises of the first casino and enter a second casino that is commercially distinct from the first casino.

In this context, "commercially distinct" refers to entities that are operate independently from one another as peers. Typically, although not necessarily, such casinos are owned by separate entities.

For example, currently, Fitzgeralds Casino in Las Vegas is owned by one individual, while the Four Queens casino is owned by a different individual. Fitzgeralds and the Four Queens are operated completely independently from one another, and are therefore commercially distinct with respect to incentive programs. If Fitzgeralds and the Four Queens were to enter an agreement sharing the same incentive program, they would still be commercially distinct, because the shared incentive program exists only by virtue of an agreement between two peers . . . entities that do not control each other. Nor was the incentive program mandated by a third party that controls both entities.

Further, Caesar's Palace, the Imperial Palace, Paris Las Vegas, and Ballys are all currently controlled by Harrah's Entertainment. If Harrah's Entertainment were to institute a single incentive program valid for play at Caesar's Palace and Paris Las Vegas, Caesar's Palace and Paris Las Vegas would not be commercially distinct casinos in the context of the establishment of incentive programs because the program was mandated by a third party that controls both entities. If, however, Caesar's Palace and Paris Las Vegas were independently operated and entered into a separate agreement to share an incentive program as peers (not by mandate from the owner Harrah's Entertainment, they would be "commercially distinct."

Figure 7B:
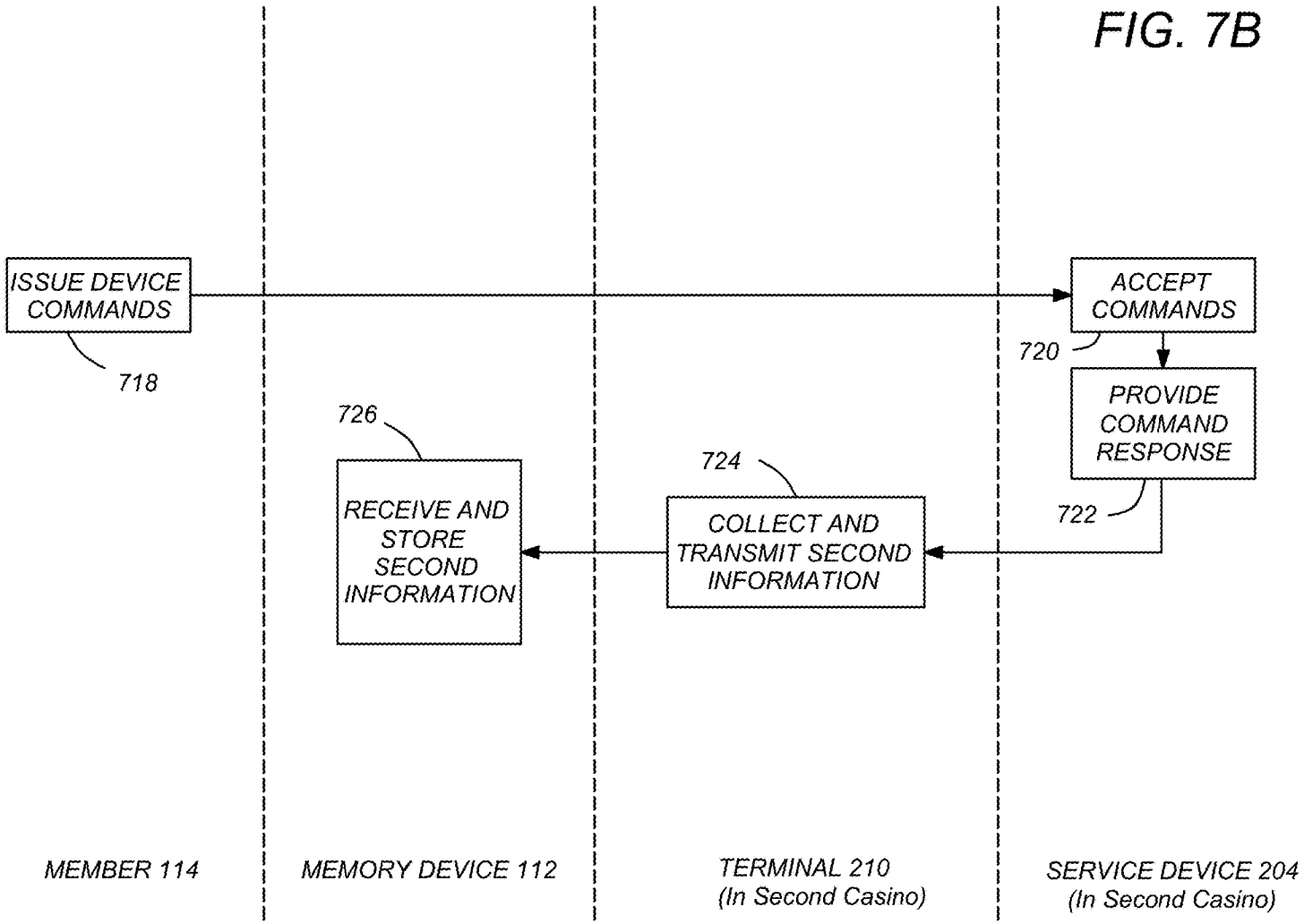

FIGS. 7A and 7B illustrate exemplary operations that can be performed at the second casino. In block 702, a second transmission is transmitted from the memory device. Again, this transmission may or may not be a wireless transmission and may include a member-unique identifier. In block 704, the second transmission is received in a terminal 210 in the second casino. Like the terminal 210 in the first casino, the second terminal is communicatively coupled to one of a second plurality of gaming devices 204 of a second casino that is commercially distinct from the first casino. Further, the plurality of second gaming devices 204 may be communicatively isolated from any entity communicatively connected with any of the other of the plurality of second gaming devices 204, and may also be communicatively isolated from any entity communicatively connected with any of the plurality of first gaming devices 204.

In blocks 705 and 706, the memory device is optionally authenticated by the transmission, reception, and processing of authentication information.

If the member 114 of the first incentive program is also a member of a second incentive program offered at the second casino, processing moves to block 718, and the member 114 begins game play using the service device 204. As illustrated in FIG. 7B, this includes the issuance of device commands, the acceptance of those commands, and providing command responses, as shown in blocks 718-722. Second information regarding the game play is collected and transmitted to the memory device, where it is received and stored, as shown in blocks 724-726.

If the member 114 is not a member of the second incentive program offered at the second casino the service device, the service device 204 may display an offer to join the incentive program of the second casino, as shown in block 708. If the user 114 accepts the enrollment offer, the service device 203 transmits a message to the terminal 210 to command the terminal to request member data from the memory device, as shown in blocks 711 and 712. This member data may include information identifying the member. The member data is provided, as shown in block 714 and returned to the terminal 210. The member data may then be stored in the terminal 210, the service device 204, or transmitted to a centralized computer of the second casino. If desired, a message may then be presented on the service device 204, indicating that the member 114 is now also a member of the second incentive program of the second casino.

FIG. 8 is a diagram showing how the incentives earned under the first incentive program and/or the second incentive program may be provided to the member 114.

First, a third transmission is made from the memory device 112 and received in a third terminal 210, as shown in blocks 802 and 804. The third terminal may be any one of the terminals 210 in the first casino, any one of the terminals 210 in the second casino, or a specialized redemption terminal communicatively coupled to a centralized computer of the first casino and or the second casino. As before, the memory device may be optionally authenticated, as shown in blocks 805 and 806. The status (whether the memory device was recognized and/or authenticated) can be displayed by the service device, as shown in block 808.

In block 810, the member requests their incentive. In one embodiment, the incentives provided at the first casino and the second casino are coordinated. That is, the first casino and the second casino have entered an agreement to provide bonuses and incentives to members 114 based not only on the first information stored in the memory device (which information was collected in connection with game play carried out at the first casino), but also based on the second information stored in the memory device (which information was collected in connection with game play carried out at the second casino). In this embodiment, the user can retrieve incentives at one casino that were earned at another.

In another embodiment, the incentives provided at the first casino and the second casino are not coordinated. In this embodiment, the member 114 will be able to retrieve only those incentives based on first information (collected in connection with game play carried out at the first casino) if the third terminal 210 is disposed in or controlled by the first casino, and be able to retrieve only those incentives based on second information (collected in connection with game play carried out at the second casino) if the third terminal is disposed in or controlled by the first casino. In this embodiment, the member 114 can only retrieve incentives that were earned at the same casino at which the game play occurred.

The incentive request is accepted by the service device 204, as shown in block 812. The terminal 210 processes and interprets that request, and commands the memory device 112 to retrieve incentive/bonus information stored therein, as shown in blocks 814. In one embodiment, the memory device 112 acts as a repository for stored bonuses only. In this embodiment, the memory device 112 simply provides the stored first and/or second information regarding game play to the terminal, and the terminal (or service device 204) determines the bonus/incentive. In another embodiment, the memory device 112 determines the bonus by a comparison of the stored first and/or second information and bonus/incentive requirements stored in the memory device 112 as shown in block 815. In either case, using either the incentive information or the comparison between the incentive information and requirements, the memory device 112 sends a message to the terminal 210 indicating whether the incentive should be provided to the member, and the terminal 210 provides a command to the service device 204 indicating that the incentive should be provided. The service device 204 accepts the command and provides the incentive, as shown in blocks 818, 820, and 826. The service device 204 sends a message to the terminal 210 to indicate that the incentive was provided. The terminal 210 commands the memory device 112 to reduce the cumulative bonus for the member stored therein by the amount provided in the incentive in block 820, and the memory device 112 respond to this command. This is illustrated in blocks 822 and 824. If desired, the foregoing process can be altered so that the incentive is not provided until after the bonus is reduced by the incentive amount.

The memory device 112 can also be configured to handle different combinations of multiple accounts and multiple customers. In this embodiment, the memory device can operate as an e-wallet, storing information regarding multiple loyalty programs for multiple customers.

For example, in one embodiment, a husband and wife could use the same memory device 112, with each having their own separate account information, including personal information about the customer, gaming activity of the customer, and incentives the customer has earned. Each person's account information may be stored in a (physically and/or logically) separate portion of the memory 302, and may be secure so as to permit access and use of the data stored in the separate portion of the memory 302 by the respective person.

In one embodiment, identification of the customer's account is accomplished as a part of the authentication process illustrated in blocks 406-408 of FIG. 4, blocks 506-508 of FIG. 5, blocks 605-608 of FIG. 6, blocks 705-706 of FIG. 7A, and/or blocks 805-806 of FIG. 8. For example, referring to FIG. 4, the member 114 presents 402 the memory device 112 to the terminal 210, which accepts 404 and authenticates 406 the memory device 112 using authentication information 408 stored in the memory device 112 and/or the terminal 210. In one embodiment, the terminal 210 requests that the member 114 enter identifying information (e.g. a name and/or a password) as a part of the authentication process. The identifying information is accepted by the service device 204 and transmitted to the memory device 112. If the name and password match corresponding information securely stored in the memory device 112, the memory device 112 is authenticated for the person corresponding to the name and password, and access to that secure portion of the memory 302 is provided. The user then uses the service device 204, with such activity recorded in the portion of the secure memory 302 allocated to that person. The process for redeeming earned incentives is analogous.

In another embodiment, two customers may share the same memory device 112, and jointly earn and/or redeem incentives, and allow access to each others' account information.

In still another embodiment, two customers may share the same memory device 112, and jointly earn and/or redeem incentives, but keep other information private from one another. For example, the activity for each customer using service devices 204 may be stored in separate secure portions of the memory 302 and made unavailable for other customers using the same memory device 112 to view, but may nonetheless be available for purposes of computing and providing incentives jointly earned by the customers. For example, if the memory device 112 is shared by a husband and wife, they may earn joint incentives according to their combined gaming activity, but the wife's gaming activity may be held secure from the husband and/or vice versa. Thus, they can jointly earn incentives without providing the other access into the specific activity that gave rise to the earned incentives.

In still another embodiment, two customers can each have separate memory devices 112, yet still maintain separate accounts that are synchronized between memory devices 112. For example, a husband may have an account having first account information stored on a first memory device and a second memory device, while the wife also has an account having first account information stored on the first memory device and the second memory device. The husband may carry the first memory device and use it to engage in activity with service devices 204 of one or more entities, and such activity may be stored in his portion of the secure memory 302 of the memory device in her possession. The wife may carry the second memory device, and use it to engage in activity with service devices 204 of one or more of the same or different entities, and such activity may be stored in her portion of the secure memory 302 of the memory device 112 in her possession.

Activity and incentives earned in each device may be held and provided separately, or may be synchronized between memory devices 112. This can be accomplished by communicatively coupling both memory devices 112 together, whether directly (or through wireless means such as the RF system described above) or via both memory devices 112 being coupled to a network 100.

Further Memory Device Embodiments

As described above, the memory device 112 itself may comprise a wireless device having a memory and a processor that performs many or all of the functions performed by the terminal 210, and that such shared functionality may provide for increased security to prevent hacking. In one embodiment, the memory device 112 comprises a smartphone, tablet computer, laptop, or other processing device having secure memory and a processor. In this embodiment, one or more processors 304 in the memory device 112 may perform all of the functions performed by the terminal 210, and selected functions performed by the service device 204 using instructions stored in the memory 302. The instructions may be uploaded to the memory device 112 in the form of a smartphone application, and the smartphone application may keep track of earned bonuses for one or more of the smartphone users for a plurality of accounts. The smartphone application may store incentive/bonus requirements, keep track of the user's interaction with establishments (e.g. shopping or browsing) and determine if earned incentives/bonuses can be provided to the user 114. In alternate embodiments, the functionality is embodied in the smartphone executing an internet browser such as Safari or Chrome, with plug-ins or other features to implement the foregoing functionality.

Further Incentive/Bonus Embodiments

Also, as described above, the memory device 112 may be used to securely store and manage incentives/bonuses obtained having monetary value redeemable at commercially distinct establishments, and that such monetary value can be obtained in connection with the purchase or use of goods and services. Commercially distinct establishments can, by agreement between the establishments or a pool of establishments, agree to accept bonus points granted by other establishments, or may simply accept them without such agreement.

One example of an incentive/bonus that takes the form of a portable electronic currency of agreed upon value among a pool of establishments comprises a cryptocurrency or cybercurrency such as BITCOIN or IOTA. Bitcoin is a peer-to-peer digital payment system that operates without a central repository or a single administrator. Transactions take place between users directly (without an intermediary) and transactions are verified by network nodes and recorded in a public distributed ledger known as a blockchain. Block chaining uses a distributed database in which transactions are broadcast to the network with each network storing its own copy of the blockchain. Initially created as an award for mining of the metadata of the underlying transactions, bitcoin can be exchanged for other currencies, products and services. IOTA (Internet of Things Analytics) is an open-source distributed ledger that uses a directed acyclic graph (DAG) instead of block chaining. Unlike block chaining systems that distinguish between individual users and block validators, DAG considers users and validators to be the same, and confirms transactions based upon previous transactions. This prevents clogging of the system and is superior for smaller transactions. Also, unlike Bitcoin, which must be added and redeemed online (offline transactions are not possible), IOTA currency can be traded offline.

Further Examples

Figure 9:
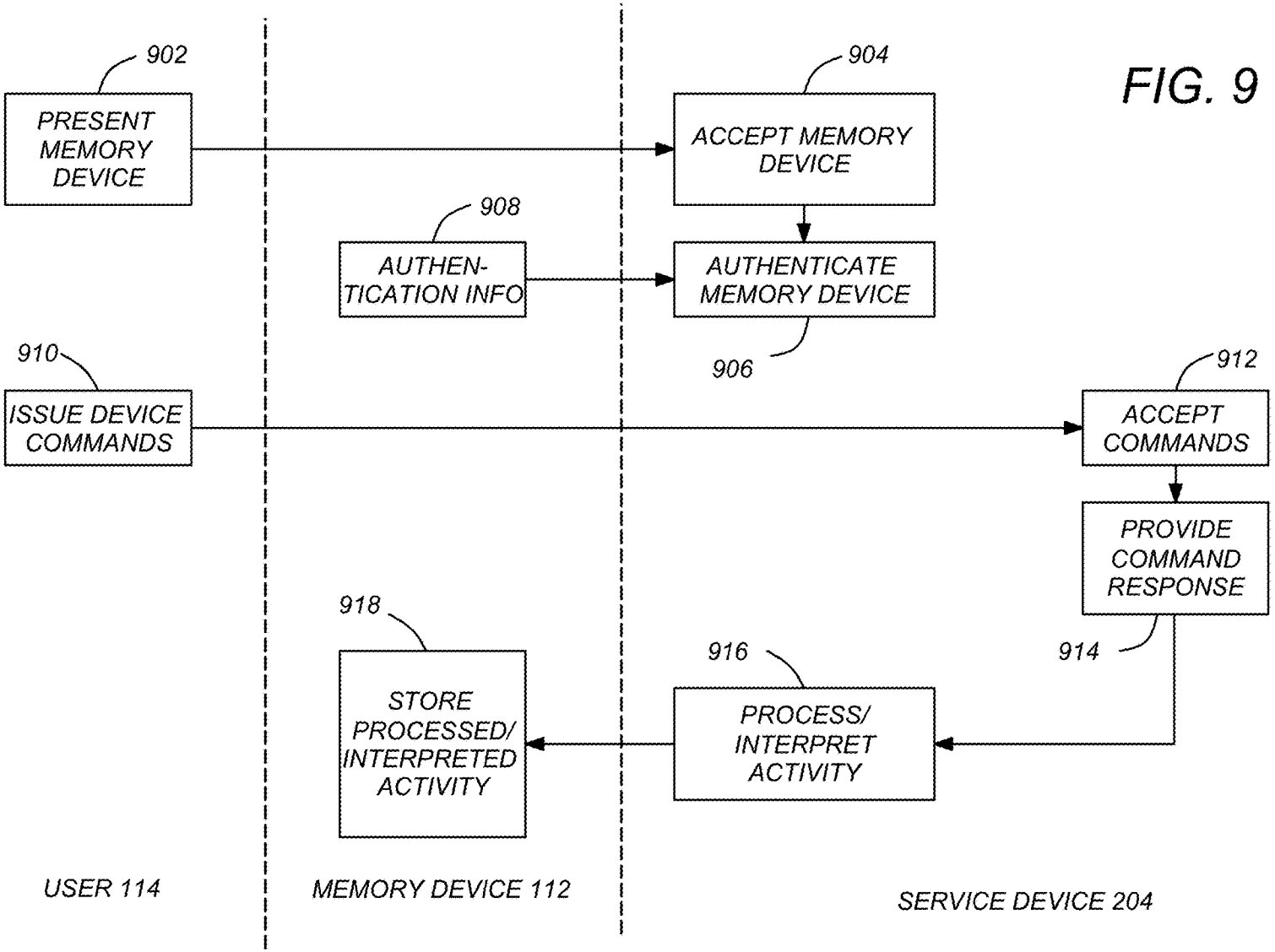
FIG. 9 is a diagram showing exemplary method steps useable to collect information relating to the user's interaction with first establishment via the memory device and a service device at the first establishment.

FIG. 9 is a diagram showing exemplary method steps useable to collect information relating to the user's interaction with first establishment via the memory device 112 and a service device 204 at the first establishment. In this embodiment, the memory device 112 comprises a smartphone or similar device having a processor and a memory 302 storing processor 304 instructions for performing the operations described below.

The user 114 presents 902 the memory device 112 to a service device 204, which accepts 904 and authenticates 906 the memory device 112 using authentication information 908 stored in the memory device 112 and/or the service device 204. The service device 204 may be a device disposed at the point of sale of a brick and mortar establishment, or a computer or server disposed at a location remote from the memory device 112 (for example, the memory device 112 may be used to communicate with a server of the first establishment).

In one embodiment, the service device 204 requests that the user 114 enter identifying information (e.g. a name and/or a password) as a part of the authentication process. If desired, the present invention can be implemented without blocks 902-808. In this embodiment, the possessor of the memory device 112 is not authenticated. However, the memory device 112 may be authenticated.

The user 114 then issues 910 service device 204 commands via an appropriate service device 204 user interface. This may include, for example, entering a monetary denomination (e.g. $20), and depressing buttons to select products or services, including the number of credits to spend, and making additional selections as desired. The service device 204 accepts 912 the commands, and provides 914 a command response. The service device 204 provides the activity information, in processed or unprocessed form, to the memory device 112, where it may be stored 918. Alternatively, the memory device 112 may keep track of activity information.

The service device 104 may also allow user 114 to read some or all of the information regarding earned incentives/bonuses, incentive/bonus detail (e.g. number of bonus points, previous purchases), or bonus requirements stored on the memory device 112.

FIG. 9 shows an embodiment of the invention wherein the processor 304 and memory 302 in the memory device 112 performs all of the functions performed by the terminal 210 processor 308 and memory 306 in previously described embodiments. This embodiment permits the present invention to be implemented without use of the previously described terminal 210, increases security, and permits the sharing of incentive/bonuses using a single device commonly available to users.

Figure 10:
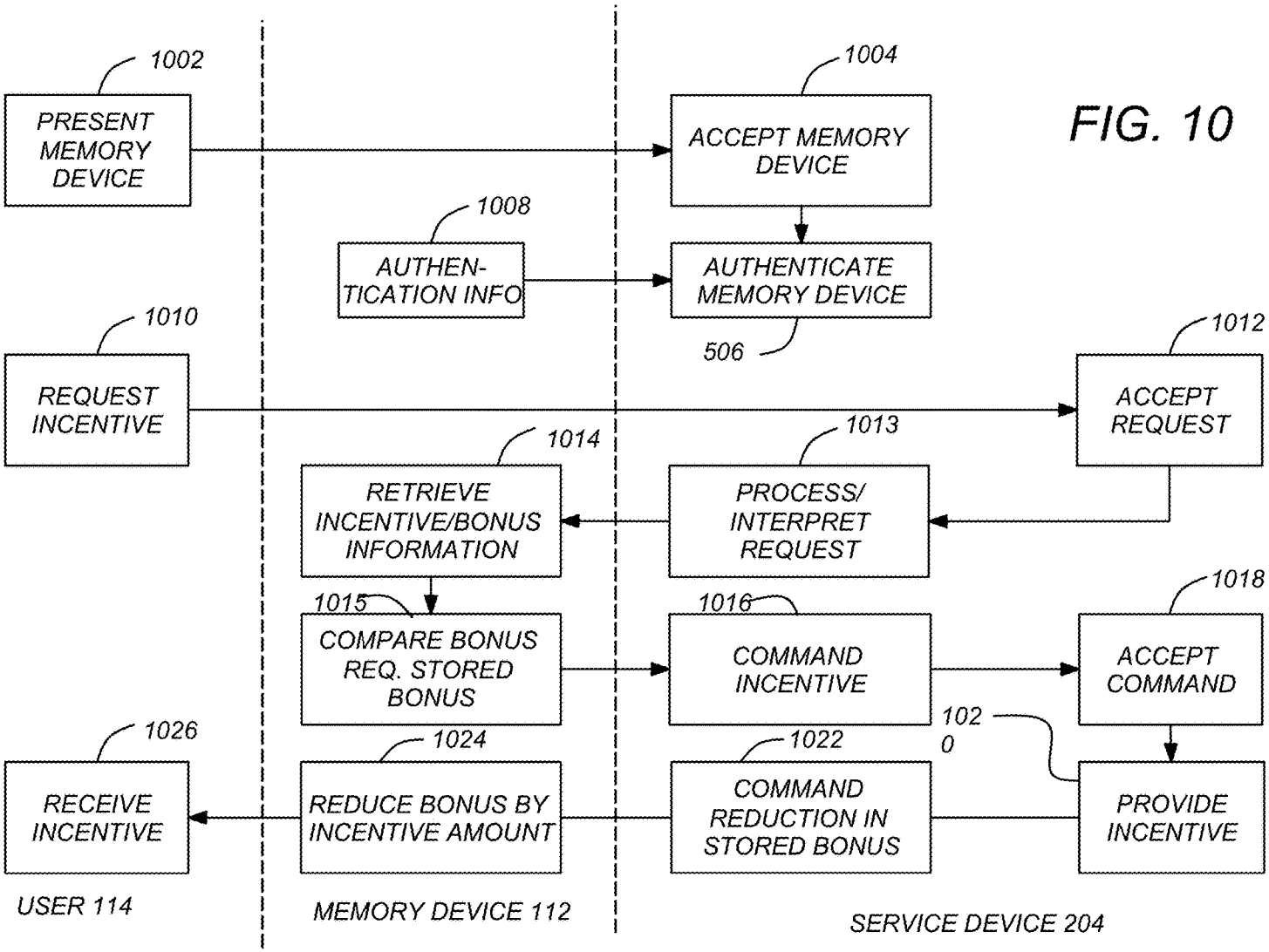
FIG. 10 is a diagram depicting exemplary method steps used to redeem incentives.

FIG. 10 is a diagram depicting exemplary method steps used to redeem incentives. The user 114 presents 1002 the memory device 112 to the service device, where it is accepted 1004. Authentication information 1008 stored in the memory device 112 and/or the terminal 210 is then used to authenticate the user 114. As before, this could involve a process whereby the user 114 provides input to the terminal and/or the service device 204 (service device 204 I/O elements can be used to provide input/output interface during authentication, accumulating bonus incentives, or in receiving incentives).

As before, the authentication process can be directed solely to processes that are required to authenticate the memory device 112, rather than the user (e.g., a case where possession of the card alone is sufficient). In this case, the user 114 accepts the risk of losing their memory device 112. Redemption devices may or may not be networked.

The user 114 then requests 1010 the incentive. The service device 204 accepts 1012 the request and transmits a message to the memory device 112 requesting incentive/bonus information stored in the memory 302 of the memory device 112. The memory device 112 retrieves 1014 the information, and provides the information to the terminal 210. The earned bonus/incentive information received from the memory device 112 is then compared with bonus/incentive requirements stored in the memory device 112 and/or the service device 204. If the comparison indicates a bonus/incentive award is appropriate, a command is provided to the service device 204 to provide the incentive. The service device 204 accepts 1018 the command, and provides 1020 the bonus/incentive. The service device and commands the memory device 112 to decrement 1024 the earned bonus by the amount redeemed. The memory device 112 accepts this command, and decrements 1024 the earned bonus by the required amount. If desired, the present invention can be implemented without decrementing the bonus counter (e.g. awarding incentives when bonus thresholds are passed and therefore, triggered).

The incentive is then received 1026 by the user 114. Alternatively, the incentive command may cause an alarm or other indication that the user 114, should be provided with a bonus, and the bonus is provided to the user by appropriate personnel alerted by the alarm.

The memory device 112 may or may not keep historical data regarding redemption transactions and earned bonuses. When the user 114 redeems bonus points or interfaces with a networked machine, the history of activity/bonus awards stored in the memory device 112 can be uploaded in the service device 204. This information can be to offer the user 114 with additional player benefits or to update the incentive/bonus structure to a more or less favorable structure than currently stored in the memory device 112.

In one embodiment, special redemption stations can be used to redeem incentive/bonus points (in addition to or in the alternative to the service devices 204). Such redemption stations can be networked and can include special functionality to permit the collection of data and the issuance of the incentive awards.

Figure 11:
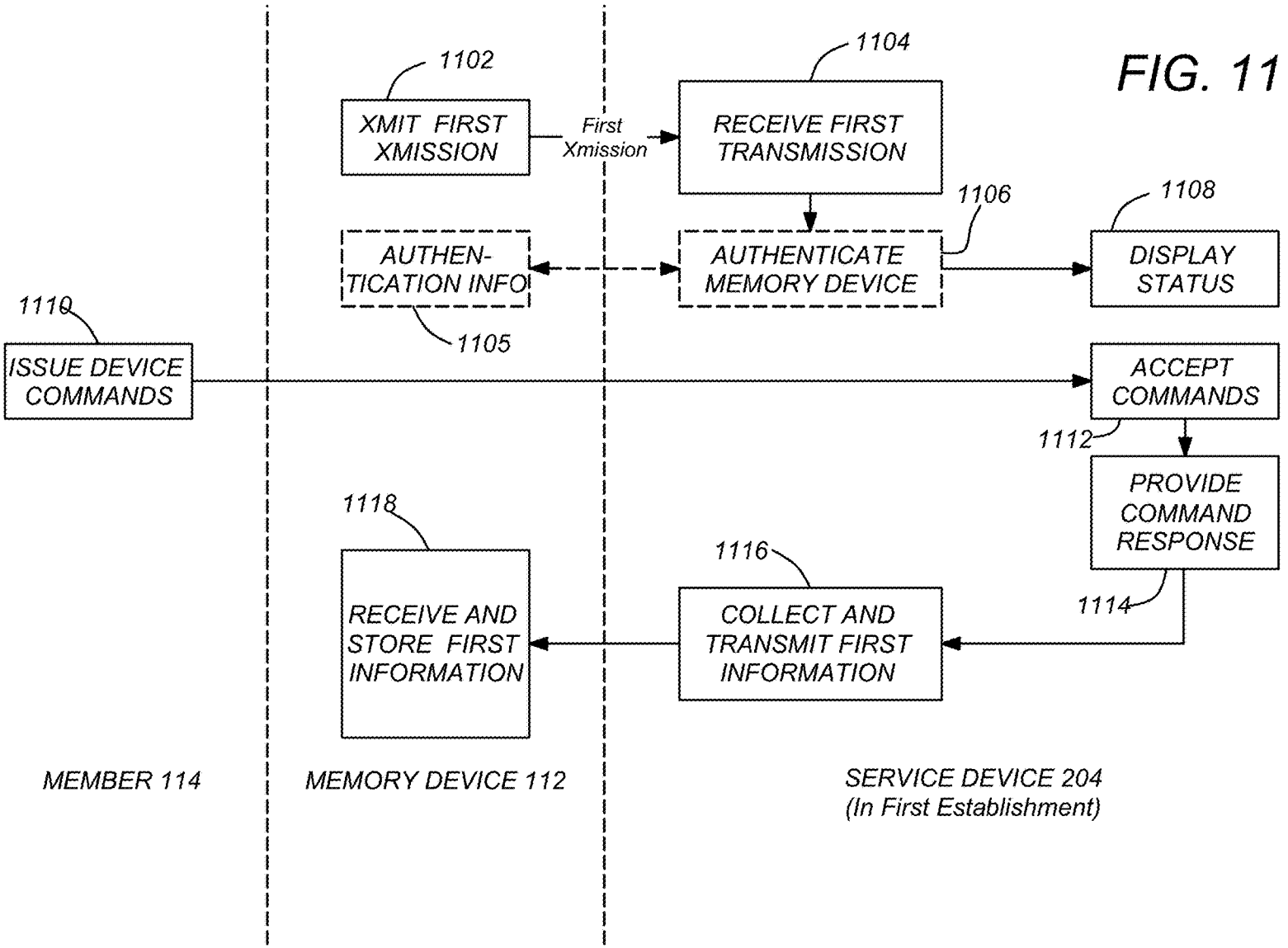

FIGS. 11-13 are diagrams presenting yet another embodiment in which the memory device 112 can be used in connection with incentive programs at commercially distinct establishments. In block 1102, the memory device 112 transmits a first transmission to a service device at the first establishment.

As described above, in this embodiment, the memory device 112 comprises a smartphone executing an application. The application executed by the memory device 112 may provided to a person that is a member of a first incentive program offered by a first establishment, typically, but not necessarily in exchange for the member's personal information and the right to collect information regarding the user's dealings with the first establishment.

In block 1104, the service device 204 receives the first transmission, which may include simply the customer unique identifier.

Using authentication information received from the memory device 112, the service device 204 can authenticate the memory device 112 before proceeding further, as shown in block 1106. The result of the authentication process can be displayed on a display of the service device 204 or the memory device 112.

Thereafter, the member 114 can issued device commands such as browsing products or services that are accepted by a service device 204 in the first establishment. This is illustrated in blocks 1110 and 1112. The service device provides a command response (e.g. display of those products or services) as shown in block 1114. The service device 204 collects and transmits first information describing the member's activity, as shown in block 1116. That information is transmitted to the memory device 112, as shown in bock 1118. As described above, the information may be transmitted from the to the memory device 112 as it is available, may be stored in and periodically transmitted to the memory device 112, or may be transmitted to the memory device 112 when the user 114 has completed shopping for goods or services. In alternative embodiments, the memory device 112 collects the first information regarding the user's activity.

Once the user 114 has cashed out, they may deactivate the memory device 112. For example, the user 114 may provide a command to end the session or simply walk away until they are out of range with the terminal 210. At this point, the user 114 may approach another service device 204 and repeat the same operations in the first establishment. However, the user 114 may leave the premises of the first establishment and enter a second establishment that is commercially distinct from the first casino.

In this context, "commercially distinct" refers to entities that are operate independently from one another as peers. Typically, although not necessarily, such casinos are owned by separate entities.

Figure 12B:
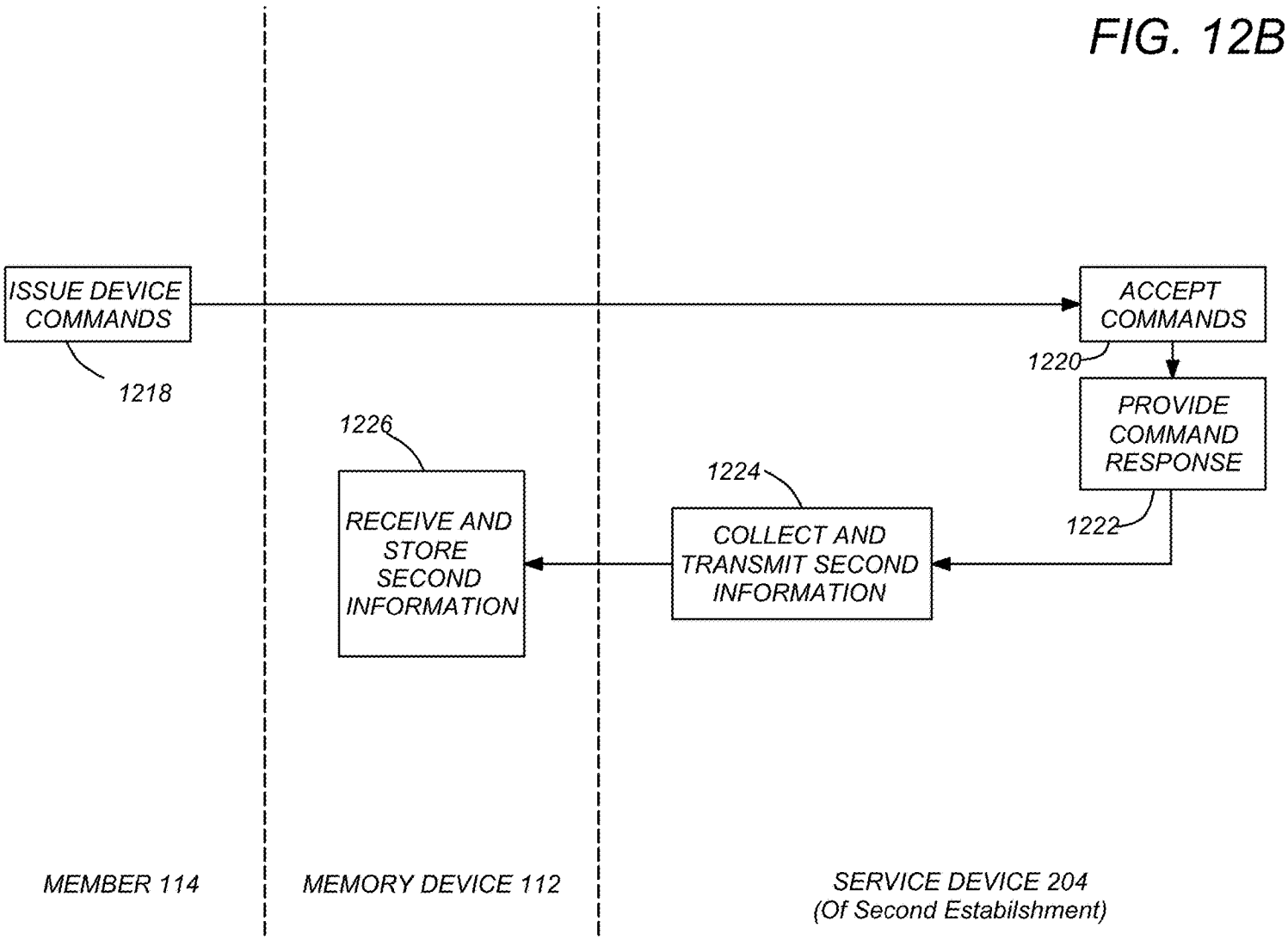

FIGS. 12A and 12B illustrate exemplary operations that can be performed at the second establishment. In block 1202, a second transmission is transmitted from the memory device 112. Again, this transmission may or may not be a wireless transmission and may include a member-unique identifier. In block 1204, the second transmission is received in a terminal 210 in the second establishment. Like the terminal 210 in the first establishment, the second terminal is communicatively coupled to one of a second plurality of service devices 204 of a second establishment that is commercially distinct from the first establishment. Further, the plurality of second service devices 204 may be communicatively isolated from any entity communicatively connected with any of the other of the plurality of second gaming devices 204, and may also be communicatively isolated from any entity communicatively connected with any of the plurality of first service devices 204.

In blocks 1205 and 1206, the memory device is optionally authenticated by the transmission, reception, and processing of authentication information. If the incentive/bonuses earned in connection with the first establishment are accepted by the second establishment, processing moves to block 1218, and the user 114 can browse and/or purchase goods and services using the service device 204 of the second establishment. Such incentive/bonuses earned at the first establishment may be redeemable at the second establishment if user 114 of the first incentive program is also a user 114 of a second incentive program offered at the second establishment, the incentive programs are coordinated, if the incentive/bonus provided by the first establishment is acceptable by the second establishment by agreement, or that the second establishment simply chooses unilaterally to accept the first establishment's incentive/bonuses. For example, if the incentive/bonus is cybercurrency such as Bitcoin or IOTA, the incentive/bonus earned at the first establishment is acceptable at the second establishment by virtue of the coordination of the first establishment and the second establishment via a third party implementing the cybercurrency paradigm or by direct agreement between the first establishment and the second establishment.

As illustrated in FIG. 12B, the aforementioned browsing or purchase of goods includes the issuance of device commands, the acceptance of those commands, and providing command responses, as shown in blocks 1218-722. Second information regarding the browsing and purchasing is collected and transmitted to the memory device 112, where it is received and stored, as shown in blocks 1224-726. Alternatively, the second information may simply be monitored by the memory device 112 and stored therein.

If the user 114 is not a member of the second incentive program offered at the second establishment, the service device 204 may display an offer to join the incentive program of the second casino, as shown in block 1208. If the user 114 accepts the enrollment offer, the service device 204 transmits a message to request member data from the memory device 112, as shown in blocks 1211 and 1212. This member data may include information identifying the member. The member data is provided, as shown in block 1214 and returned to the terminal 210. The member data may then be stored in the terminal 210, the service device 204, or transmitted to a centralized computer of the second casino. If desired, a message may then be presented on the service device 204, indicating that the user 114 is now also a member of the second incentive program of the second casino.

FIG. 13 is a diagram showing how the incentives earned under the first incentive program and/or the second incentive program may be provided to the user 114.

First, a third transmission is made from the memory device 112 and received in a third service device 204 of the second establishment, as shown in blocks 1302 and 1304. The third service device 204 may be any one of the service devices of the first establishment, any one of the service devices of the second establishment, or a specialized redemption terminal communicatively coupled to a centralized computer of the first establishment and/or the second establishment. As before, the memory device 112 may be optionally authenticated, as shown in blocks 1305 and 1306. The status (whether the memory device 112 was recognized and/or authenticated) can be displayed by the service device 204, as shown in block 1308.

In block 1310, the user 114 requests their incentive. In one embodiment, the incentives provided at the first establishment and the second establishment are coordinated. That is, the first establishment and the second establishment have entered an agreement to provide bonuses and incentives to users 114 based not only on the first information stored in the memory device 112 (which information was collected in connection with the user's dealings with the first establishment), but also based on the second information stored in the memory device 112 (which information was collected in connection with the user's dealings with the second establishment). In this embodiment, the user can retrieve incentives at one establishment that were earned at another.

In another embodiment, the incentives provided at the first establishment and the second establishment are not coordinated and hence the incentives earned for the first establishment cannot be redeemed or used in connection with the second establishment. In this embodiment, the user 114 will be able to retrieve only those incentives based on first information (collected in connection with activities at the first establishment) if the third service device 204 is disposed in or controlled by the first establishment, and be able to retrieve only those incentives based on second information (collected in connection with activities carried out at the second establishment) if the third service device is disposed in or controlled by the first establishment. In this embodiment, the user 114 can only retrieve incentives that were earned at the same establishment in which the activities occurred.

The incentive request is accepted by the service device 204, as shown in block 1312. The service device 204 processes and interprets that request, and commands the memory device 112 to retrieve incentive/bonus information stored therein, as shown in block 1314. In one embodiment, the memory device 112 acts as a repository for stored bonuses only. In this embodiment, the memory device 112 simply provides the stored first and/or second information regarding activities to the service device 204, and the or service device 204 determines the bonus/incentive. In another embodiment, the memory device 112 determines the incentive/bonus (e.g. by a comparison of the stored first and/or second information and bonus/incentive requirements stored in the memory device 112 as shown in block 1315, or by simply reading the incentive/bonus from memory). In either case, using either the incentive information or the comparison between the incentive information and requirements, the memory device 112 sends a message to the service device 204 requesting that the incentive be provided. The service device 204 accepts the command and provides the incentive, as shown in blocks 1318, 1320, and 1326. The service device 204 sends a message to the memory device 112 to indicate that the incentive was provided. The memory device 112 reduces the cumulative bonus for the member stored therein by the amount provided in the incentive in block 1320. This is illustrated in blocks 1322 and 1324. If desired, the foregoing process can be altered so that the incentive is not provided until after the bonus is reduced by the incentive amount.

CONCLUSION

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method of providing an incentive to a user, the method comprising the steps of:

receiving a first transmission from a secure memory device in one of a plurality of first devices of a first establishment;

wherein the secure memory device has a secure memory for storing first customer incentive information for a first incentive program of the first establishment having the incentive and second customer incentive information for a second incentive program of a second establishment commercially distinct from the first establishment;

wherein the plurality of first devices includes at least a subset of first devices that are communicatively isolated from any entity communicatively connected with any of other of the plurality of first devices;

securely transmitting first device activity information to the secure memory device for storage in the secure memory;

receiving a second transmission from the secure memory device in one of a second plurality of devices of the second establishment;

wherein the plurality of second devices includes at least a subset of second devices that are communicatively isolated from any entity communicatively connected with any of the other of the plurality of second devices; and securely transmitting second activity information to the secure memory device for storage in the secure memory;

wherein the incentive is redeemable at a first establishment or a second establishment.

2. The method of claim 1, wherein the first transmission is received via a wireless link.

3. The method of claim 2, wherein the secure memory device comprises a smartphone.

4. The method of claim 3, wherein the incentive comprises a cryptocurrency.

5. The method of claim 1, wherein the incentive is redeemable at the first establishment or the second establishment, and the method further comprises the steps of:

receiving a third transmission from the secure memory device in another one of the plurality of first devices of the first establishment or in another one of the plurality of second devices of the second establishment;

receiving a request to issue an incentive based on the first customer incentive information and the second customer incentive information; and providing the requested incentive.

6. The method of claim 5, wherein the incentive is based only on data received from the secure memory device.

7. The method of claim 1, wherein the first incentive program of the first establishment and the second incentive program of the second establishment are not coordinated, and wherein the method further comprises the steps of:

receiving a third transmission from the secure memory device;

receiving a request to issue an incentive based on the first customer incentive information and not based on the second customer incentive information; and providing the incentive.

8. The method of claim 7, wherein the third transmission and the request are received in another one of the plurality of first devices of the first establishment.

9. The method of claim 8, wherein the incentive is based only on data received from the secure memory device.

10. The method of claim 7, wherein the first transmission, second transmission, and the third transmission identifies the secure memory device and does not identify a user of the secure memory device.

11. The method of claim 1, wherein:

the second transmission comprises user-identifying data;

the user is a member of the first incentive program of the first establishment; and the method further comprises the step of enrolling the member of the first incentive program of the first establishment in the second incentive program of the second establishment by transmitting the member-identifying data to a centralized computer of the second establishment.

12. The method of claim 11, further comprising the step of:

securely transmitting second incentive program information to the secure memory device for storage in the secure memory.

13. The method of claim 1, wherein:

the secure memory device further stores a customer-unique identifier; and the first transmission and the second transmission include the customer-unique identifier.

14. The method of claim 1, wherein a user of the secure memory device is enrolled in the first incentive program and is enrolled in the second incentive program.

15. The method of claim 1, wherein:

the first transmission is received and the first customer incentive information is transmitted via a first terminal communicatively coupled to the secure memory device and the one of the plurality of first devices of the first establishment; and the second transmission is received and the second customer incentive information is transmitted via a second terminal communicatively coupled to the secure memory device and the one of the second plurality of devices of the second establishment.

16. An apparatus for providing an incentive to a user, comprising:

a processor, communicatively coupled to a memory storing processor instructions including processor instructions for:

receiving a first transmission from a secure memory device in one of a plurality of first devices of a first establishment; and wherein the secure memory device has a secure memory for storing first customer incentive information for a first incentive program of the first establishment having the incentive and second customer incentive information for a second incentive program of a second establishment commercially distinct from the first establishment;

wherein the plurality of first devices includes at least a subset of first devices that are communicatively isolated from any entity communicatively connected with any of other of the plurality of first devices;

securely transmitting first device activity information to the secure memory device for storage in the secure memory;

receiving a second transmission from the secure memory device in one of a second plurality of devices of the second establishment; and wherein the plurality of second devices includes at least a subset of second devices that are communicatively isolated from any entity communicatively connected with any of the other of the plurality of second devices; and securely transmitting second device activity information to the secure memory device for storage in the secure memory wherein the incentive is redeemable at a first establishment or a second establishment.

17. The apparatus of claim 16, wherein the first transmission is received via a wireless link.

18. The apparatus of claim 17, wherein the secure memory device comprises a smartphone.

19. The apparatus of claim 18, wherein the incentive comprises a cryptocurrency.

20. The apparatus of claim 16, wherein:

the incentive is redeemable at the first establishment or the second establishment, and the processor instructions further comprise processor instructions for:

receiving a third transmission from the secure memory device in another one of the plurality of first devices of the first establishment or in another one of the plurality of second devices of the second establishment;

receiving a request to issue an incentive based on the first customer incentive information and the second customer incentive information; and providing the requested incentive.

21. The apparatus of claim 20, wherein the incentive is based only on data received from the secure memory device.

22. The apparatus of claim 16, wherein the first incentive program of the first establishment and the second incentive program of the second establishment are not coordinated, and wherein the apparatus further comprises:

a second processor, communicatively coupled to a second memory storing second processor instructions comprising second processor instructions for:

receiving a third transmission from the secure memory device;

receiving a request to issue an incentive based on the first customer incentive information and not based on the second customer incentive information; and providing the incentive.

23. The apparatus of claim 22, wherein the second processor is disposed in one of the plurality of first devices of the first establishment.

24. The apparatus of claim 23, wherein the incentive is based only on data received from the secure memory device.

25. The apparatus of claim 22, wherein the first transmission, second transmission, and the third transmission identifies the secure memory device and does not identify a user of the secure memory device.

26. The apparatus of claim 16, wherein:

the second transmission comprises user-identifying data;

the user is a member of the first incentive program of the first establishment; and the instructions further comprises instructions for enrolling the member of the first incentive program of the first establishment in the second incentive program of the second establishment by transmitting the member-identifying data to a centralized computer of the second establishment.

27. The apparatus of claim 26, wherein the instructions further comprise instructions for:

securely transmitting second incentive program information to the secure memory device for storage in the secure memory.

28. The apparatus of claim 16, wherein:

the secure memory device further stores a customer-unique identifier; and the first transmission and the second transmission include the customer-unique identifier.

29. The apparatus of claim 16, wherein a user of the secure memory device is enrolled in the first incentive program and is enrolled in the second incentive program.

30. The apparatus of claim 16, wherein:

the first transmission is received and the first customer incentive information is transmitted via a first terminal communicatively coupled to the secure memory device and the one of the plurality of first devices of the first establishment; and the second transmission is received and the second customer incentive information is transmitted via a second terminal communicatively coupled to the secure memory device and the one of the second plurality of devices of the second establishment.

31. A method of providing incentives to a user, comprising the steps of:

transmitting a first transmission from a secure memory device to one of a plurality of first devices of a first establishment; and wherein the secure memory device has a secure memory for storing first customer incentive information for a first incentive program of the first establishment having the incentive and second customer incentive information for a second incentive program of a second establishment commercially distinct from the first establishment;

wherein the plurality of first devices includes at least a subset of first devices that are communicatively isolated from any entity communicatively connected with any of other of the plurality of first devices;

securely receiving first device activity information in the secure memory device for storage in the secure memory;

transmitting a second transmission from the secure memory device to one of a second plurality of devices of the second establishment;

wherein the plurality of second devices includes at least a subset of second devices that are communicatively isolated from any entity communicatively connected with any of the other of the plurality of second devices; and securely receiving second activity information in the secure memory device for storage in the secure memory;

wherein the incentive is redeemable at a first establishment or a second establishment.

32. The method of claim 31, wherein the first transmission is received via a wireless link.

33. The method of claim 32, wherein the secure memory device comprises a smartphone.

34. The method of claim 33, wherein the incentive comprises a cryptocurrency.

35. The method of claim 31, wherein the first incentive program of the first establishment and the second incentive program of the second establishment are coordinated, and the method further comprises the steps of:

transmitting a third transmission from the secure memory device to another one of the plurality of first devices of the first establishment or to another one of the plurality of second devices of the second establishment;

transmitting a request to issue an incentive based on the first customer incentive information and the second customer incentive information; and receiving the requested incentive.

36. The method of claim 35, wherein the incentive is based only on data received from the secure memory device.

37. The method of claim 31, wherein the first incentive program of the first establishment and the second incentive program of the second establishment are not coordinated, and wherein the method further comprises the steps of:

transmitting a third transmission from the secure memory device;

transmitting a request to issue an incentive based on the first customer incentive information and not based on the second customer incentive information; and receiving the incentive.

38. The method of claim 37, wherein the third transmission and the request are transmitted to another one of the plurality of first devices of the first establishment.

39. The method of claim 38, wherein the incentive is based only on data received from the secure memory device.

40. The method of claim 37, wherein the first transmission, second transmission, and the third transmission identifies the secure memory device and does not identify a user of the secure memory device.

41. The method of claim 31, wherein:

the second transmission comprises user-identifying data;

the user is a member of the first incentive program of the first establishment; and the method further comprises the step of enrolling the member of the first incentive program of the first establishment in the second incentive program of the second establishment by transmitting the member-identifying data to from a second terminal to a centralized computer of the second establishment.

42. The method of claim 41, further comprising the step of:

securely receiving second incentive program information to the secure memory device for storage in the secure memory.

43. The method of claim 31, wherein:

the secure memory device further stores a customer-unique identifier; and the first transmission and the second transmission include the customer-unique identifier.

44. The method of claim 31, wherein a user of the secure memory device is enrolled in the first incentive program and is enrolled in the second incentive program.

45. The method of claim 31, wherein:

the first transmission is received and the first customer incentive information is transmitted via a first terminal communicatively coupled to the secure memory device and the one of the plurality of first devices of the first establishment; and the second transmission is received and the second customer incentive information is transmitted via a second terminal communicatively coupled to the secure memory device and the one of the second plurality of devices of the second establishment.

46. An apparatus of providing an incentive to a user, comprising:

a processor, communicatively coupled to a memory storing processor instructions including processor instructions for:

transmitting a first transmission from a secure memory device to one of a plurality of first devices of a first establishment and for transmitting a second transmission from the secure memory device to one of a plurality of second devices of a second establishment;

wherein the secure memory device has a secure memory for storing first customer incentive information for a first incentive program of the first establishment having the incentive and second customer incentive information for a second incentive program of a second establishment commercially distinct from the first establishment;

wherein the plurality of first devices includes at least a subset of first devices that are communicatively isolated from any entity communicatively connected with any of other of the plurality of first devices;

wherein the plurality of second devices includes at least a subset of second devices that are communicatively isolated from any entity communicatively connected with any of the other of the plurality of second devices; and securely receiving first device activity information in the secure memory device for storage in the secure memory and for receiving second activity information in the secure memory device for storage in the secure memory;

wherein the incentive is redeemable at a first establishment or a second establishment.

47. The apparatus of claim 46, wherein the first transmission is transmitted via a wireless link.

48. The apparatus of claim 47, wherein the secure memory device comprises a smartphone.

49. The apparatus of claim 48, wherein the incentive comprises a cryptocurrency.

50. The apparatus of claim 46, wherein the first incentive program of the first establishment and the second incentive program of the second establishment are coordinated, and wherein:

the processor instructions for transmitting the first transmission from a secure memory device to one of a plurality of devices further transmits a third transmission from the secure memory device to another one of the plurality of first devices of the first establishment or to another one of the plurality of second devices of the second establishment;

the instructions further comprise instructions for:

transmitting a request to issue an incentive based on the first customer incentive information and the second customer incentive information; and receiving the requested incentive.

51. The apparatus of claim 50, wherein the incentive is based only on data received from the secure memory device.

52. The apparatus of claim 46, wherein the first incentive program of the first establishment and the second incentive program of the second establishment are not coordinated, and wherein:

the transmitting the first transmission from a secure memory device to the one of a plurality of devices further comprises transmitting a third transmission from the secure memory device;

the instructions further comprise instructions for:

transmitting a request to issue an incentive based on the first customer incentive information and not based on the second customer incentive information; and receiving the incentive.

53. The apparatus of claim 52, wherein the third transmission and the request are transmitted to another one of the plurality of first devices of the first establishment.

54. The apparatus of claim 53, wherein the incentive is based only on data received from the secure memory device.

55. The apparatus of claim 52, wherein the first transmission, second transmission, and the third transmission identifies the secure memory device and does not identify a user of the secure memory device.

56. The apparatus of claim 46, wherein:

the second transmission comprises user-identifying data;

the user is a member of the first incentive program of the first establishment; and the apparatus further enrollings the member of the first incentive program of the first establishment in the second incentive program of the second establishment by transmitting the member-identifying data to a centralized computer of the second establishment.

57. The apparatus of claim 56, wherein the processor instructions further comprise processor instructions for:

securely receiving second incentive program information to the secure memory device for storage in the secure memory.

58. The apparatus of claim 46, wherein:

the secure memory device further stores a customer-unique identifier; and the first transmission and the second transmission include the customer-unique identifier.

59. The apparatus of claim 46, wherein a user of the secure memory device is enrolled in the first incentive program and is enrolled in the second incentive program.

60. The apparatus of claim 46, wherein:

the first transmission is received and the first customer incentive information is transmitted via a first terminal communicatively coupled to the secure memory device and the one of the plurality of first devices of the first establishment; and the second transmission is received and the second customer incentive information is transmitted via a second terminal communicatively coupled to the secure memory device and the one of the second plurality of devices of the second establishment.

61. An apparatus of providing an incentive to a user, comprising:

a secure memory device, comprising:

a secure memory for storing first customer incentive information for a first incentive program of a first establishment having the incentive and second customer incentive information for a second incentive program of a second establishment commercially distinct from the first establishment;

a processor, communicatively coupled to the secure memory, the processor performing instructions comprising instructions for:

transmitting a first transmission from a secure memory device to one of a plurality of first devices of a first establishment and for transmitting a second transmission from the secure memory device to one of a plurality of second devices of a second establishment;

securely receiving first device activity information in the secure memory device for storage in the secure memory and for receiving second activity information in the secure memory device for storage in the secure memory;

wherein the plurality of first devices includes at least a subset of first devices that are communicatively isolated from any entity communicatively connected with any of other of the plurality of first devices; and wherein the plurality of second devices includes at least a subset of second devices that are communicatively isolated from any entity communicatively connected with any of the other of the plurality of second devices;

wherein the incentive is redeemable at a first establishment or a second establishment.

62. The apparatus of claim 61, wherein the first transmission is transmitted via a wireless link.

63. The apparatus of claim 62, wherein the secure memory device comprises a smartphone.

64. The apparatus of claim 63, wherein the incentive comprises a cryptocurrency.

65. The apparatus of claim 61, wherein the first incentive program of the first establishment and the second incentive program of the second establishment are coordinated, and wherein:

the instructions further comprise instructions for transmitting a third transmission from the secure memory device to another one of the plurality of first devices of the first establishment or to another one of the plurality of second devices of the second establishment;

transmitting a request to issue an incentive based on the first customer incentive information and the second customer incentive information; and receiving the requested incentive.

66. The apparatus of claim 65, wherein the incentive is based only on data received from the secure memory device.

67. The apparatus of claim 61, wherein the first incentive program of the first establishment and the second incentive program of the second establishment are not coordinated, and wherein the instructions further comprise instructions for:

transmitting a third transmission from the secure memory device;

transmitting a request to issue an incentive based on the first customer incentive information and not based on the second customer incentive information; and receiving the incentive.

68. The apparatus of claim 67, wherein the third transmission and the request are transmitted to another one of the plurality of first devices of the first establishment.

69. The apparatus of claim 68, wherein the incentive is based only on data received from the secure memory device.

70. The apparatus of claim 67, wherein the first transmission, second transmission, and the third transmission identifies the secure memory device and does not identify a user of the secure memory device.

71. The apparatus of claim 61, wherein:

the second transmission comprises user-identifying data;

the user is a member of the first incentive program of the first establishment; and the instructions further comprise instructions for enrolling the member of the first incentive program of the first establishment in the second incentive program of the second establishment by transmitting the member-identifying data to a centralized computer of the second establishment.

72. The apparatus of claim 71, wherein the instructions further comprise instructions for:

securely receiving second incentive program information to the secure memory device for storage in the secure memory.

73. The apparatus of claim 61, wherein:

the secure memory device further stores a customer-unique identifier; and the first transmission and the second transmission include the customer-unique identifier.

74. The apparatus of claim 61, wherein a user of the secure memory device is enrolled in the first incentive program and is enrolled in the second incentive program.

75. The apparatus of claim 61, wherein:

the first transmission is received and the first customer incentive information is transmitted via a first terminal communicatively coupled to the secure memory device and the one of the plurality of first devices of the first establishment; and the second transmission is received and the second customer incentive information is transmitted via a second terminal communicatively coupled to the secure memory device and the one of the second plurality of devices of the second establishment.

* * * * *